US010744787B2

(12) United States Patent
Harada et al.

(10) Patent No.: US 10,744,787 B2
(45) Date of Patent: Aug. 18, 2020

(54) LIQUID DROPLET DISCHARGING APPARATUS, LIQUID DROPLET DISCHARGING METHOD, AND NON-TRANSITORY COMPUTER READABLE MEDIUM

(71) Applicant: Ricoh Company, Ltd., Tokyo (JP)

(72) Inventors: Yasunari Harada, Kanagawa (JP); Jun Watanabe, Tokyo (JP); Tetsuyoshi Nakata, Kanagawa (JP); Hideaki Iijima, Kanagawa (JP); Toshiaki Hosokawa, Shiga (JP); Shunsuke Shitaoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 109 days.

(21) Appl. No.: 15/904,480

(22) Filed: Feb. 26, 2018

(65) Prior Publication Data

US 2018/0250948 A1 Sep. 6, 2018

(30) Foreign Application Priority Data

Mar. 3, 2017 (JP) ..... 2017-041168

(51) Int. Cl.
*B41J 2/21* (2006.01)
*B41J 2/165* (2006.01)
(Continued)

(52) U.S. Cl.
CPC ..... *B41J 2/2139* (2013.01); *B41J 2/155* (2013.01); *B41J 2/165* (2013.01); *B41J 2/1652* (2013.01);
(Continued)

(58) Field of Classification Search
CPC ..... B41J 2/2139; B41J 2/16505; B41J 2/165; B41J 2/1652; B41J 3/36; B41J 2/2146;
(Continued)

(56) References Cited

U.S. PATENT DOCUMENTS 8,033,630 B2 * 10/2011 Miyamoto ..... B41J 2/2139 347/12
2002/0158955 A1 * 10/2002 Hess ..... B41J 3/28 347/108
(Continued)

FOREIGN PATENT DOCUMENTS

JP 10-16316 A 1/1998
JP 2016-112700 6/2016
(Continued)

OTHER PUBLICATIONS

Extended European Search Report dated Jul. 13, 2018 in Patent Application No. 18156278.6, 10 pages.

*Primary Examiner* — Justin Seo
(74) *Attorney, Agent, or Firm* — Xsensus LLP

(57) ABSTRACT

A liquid droplet discharging apparatus includes a plurality of nozzles to discharge a liquid droplet onto a medium and a liquid droplet discharging controller to receive image data. The liquid droplet discharging controller controls each of the nozzles to discharge the liquid droplet in an amount defined by the image data onto a target discharging position on the medium, which corresponds to a pixel position defined by the image data. The liquid droplet discharging controller controls at least one of the nozzles to discharge the liquid droplet for a controlled number of times smaller than a number of times N representing an integer not smaller than 2 in an amount greater than the amount defined by the image data onto the target discharging position on the medium. A frequency recorder records the controlled number of times of discharging for each of the at least one of the nozzles.

10 Claims, 19 Drawing Sheets

(51) Int. Cl.
*B41J 2/155* (2006.01)
*B41J 3/36* (2006.01)

(52) U.S. Cl.
CPC ..... *B41J 2/16505* (2013.01); *B41J 2/16579* (2013.01); *B41J 2/2142* (2013.01); *B41J 2/2146* (2013.01); *B41J 3/36* (2013.01); *B41J 2002/16529* (2013.01)

(58) Field of Classification Search
CPC ..... B41J 2/155; B41J 2/16579; B41J 2/2142; B41J 2002/16529
See application file for complete search history.

(56) References Cited

U.S. PATENT DOCUMENTS

| | | | | |
|---|---|---|---|---|
| 2005/0018009 | A1* | 1/2005 | Otsubo | B41J 2/16523 347/36 |
| 2006/0050131 | A1 | 3/2006 | Breton | |
| 2007/0263063 | A1 | 11/2007 | Reed et al. | |
| 2016/0082719 | A1 | 3/2016 | Harada et al. | |
| 2016/0339720 | A1 | 11/2016 | Tanaka | |

FOREIGN PATENT DOCUMENTS

| | | | |
|---|---|---|---|
| WO | WO 03/076196 | A1 | 9/2003 |
| WO | WO2008/109536 | A1 | 9/2008 |

* cited by examiner

LIQUID DROPLET DISCHARGING APPARATUS, LIQUID DROPLET DISCHARGING METHOD, AND NON-TRANSITORY COMPUTER READABLE MEDIUM

CROSS-REFERENCE TO RELATED APPLICATION

This patent application is based on and claims priority pursuant to 35 U.S.C. § 119 to Japanese Patent Application No. 2017-041168, filed on Mar. 3, 2017, in the Japanese Patent Office, the entire disclosure of which is hereby incorporated by reference herein.

BACKGROUND

Technical Field

Exemplary embodiments generally relate to a liquid droplet discharging apparatus, a liquid droplet discharging method, and a non-transitory computer readable medium, and more particularly, to a liquid droplet discharging apparatus for discharging a liquid droplet onto a medium, a liquid droplet discharging method performed by the liquid droplet discharging apparatus, and a non-transitory computer readable medium for performing the liquid droplet discharging method.

Background Art

A related-art printer discharges liquid such as ink onto a sheet when the sheet conveyed by a sheet conveyer reaches an image forming position, thus forming an image on the sheet. Conversely, a liquid droplet discharging apparatus such as a handy mobile printer (HMP) does not incorporate the sheet conveyer and is downsized. Since the sheet conveyer is not installed in the HMP, a user moves the HMP to scan the sheet while the HMP discharges ink onto the sheet.

The HMP includes a nozzle that discharges ink onto the sheet. If ink adhered to the nozzle dries, the nozzle may not discharge ink properly, degrading an image formed on a sheet.

SUMMARY

This specification describes below an improved liquid droplet discharging apparatus. In one embodiment, the liquid droplet discharging apparatus includes a plurality of nozzles to discharge a liquid droplet onto a medium and a liquid droplet discharging controller to receive image data. The liquid droplet discharging controller controls each of the nozzles to discharge the liquid droplet in an amount defined by the image data onto a target discharging position on the medium, which corresponds to a pixel position defined by the image data. The liquid droplet discharging controller controls at least one of the nozzles to discharge the liquid droplet for a controlled number of times smaller than a number of times N representing an integer not smaller than 2 in an amount greater than the amount defined by the image data onto the target discharging position on the medium. A frequency recorder records the controlled number of times of discharging for each of the at least one of the nozzles.

This specification further describes an improved liquid droplet discharging method for discharging a liquid droplet onto a medium. The liquid droplet discharging method includes receiving image data, controlling each of a plurality of nozzles to discharge a liquid droplet in an amount defined by the image data onto a target discharging position on a medium, which corresponds to a pixel position defined by the image data, controlling at least one of the nozzles to discharge the liquid droplet for a controlled number of times smaller than a number of times N, N representing an integer not smaller than 2, in an amount greater than the amount defined by the image data onto the target discharging position on the medium, and recording the controlled number of times of discharging for each of the at least one of nozzles.

This specification further describes an improved non-transitory computer readable medium storing a plurality of instructions, which when executed by one or more processors, causes the processors to perform the liquid droplet discharging method described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1B:
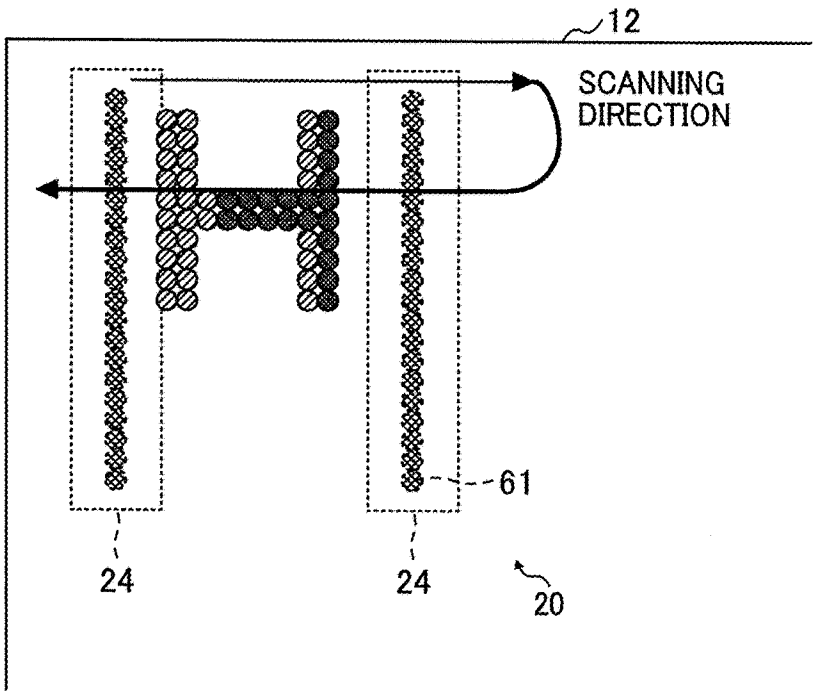
FIG. 1B is a schematic diagram of the HMP depicted in FIG. 1A, illustrating image formation.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Figure 1A:
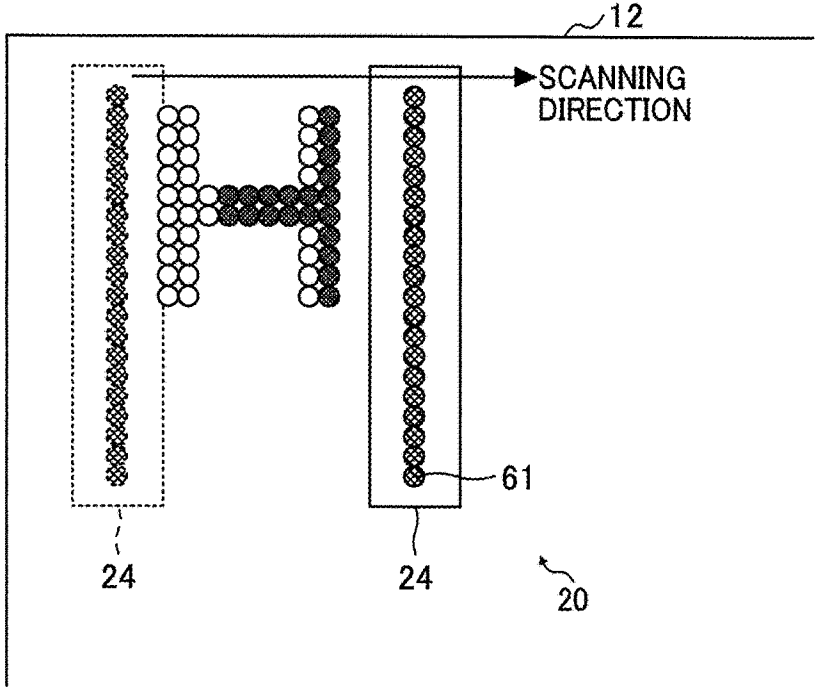
FIG. 1A is a schematic diagram of a handy mobile printer (HMP) according to a first embodiment of the present disclosure.

Referring now to the drawings, wherein like reference numerals designate identical or corresponding parts throughout the several views, particularly to FIG. 1A, a handy mobile printer (HMP) according to a first embodiment is explained.

Referring to drawings, a description is provided of a construction of a liquid droplet discharging apparatus and a liquid droplet discharging method performed by the liquid droplet discharging apparatus.

A description is provided of a first embodiment of the present disclosure.

Referring to FIGS. 1A and 1B, a description is provided of a schematic operation of a handy mobile printer (HMP) 20.

The HMP 20 according to the first embodiment operates as below to suppress failures caused by drying of ink adhered to a discharging portion, that is, a plurality of nozzles 61. For example, the HMP 20 does not record that ink has been discharged onto a pixel until each of the nozzles 61 discharges liquid droplets (e.g., ink droplets) for a number of times N. N represents an integer not smaller than 2.

Referring to FIGS. 1A and 1B, a description is provided of an operation of the HMP 20.

FIG. 1A is a schematic diagram of the HMP 20, illustrating an image formed on a print medium 12 and the nozzles 61 as one example.

First, for comparison, referring to FIG. 1A, a description is provided of a failure that occurs as ink adhered to the nozzles 61 dries.

FIG. 1A illustrates the nozzles 61 aligned vertically in FIG. 1A. Although the nozzles 61 attempt to discharge ink to form a letter H as an image, since some of the ink is not discharged, the letter H is not visible clearly.

A user moves the HMP 20, incorporating an inkjet (IJ) recording head 24 described below, placed over an upper left part of the print medium 12 rightward in FIG. 1A in a scanning direction so that the HMP 20 scans the print medium 12. When the HMP 20 determines that the nozzles 61 are at pixel positions (e.g., target discharging positions) for the letter H, the nozzles 61 discharge ink corresponding to pixels, respectively. In FIG. 1A, each of the nozzles 61 moves from a position on the left of the letter H and reaches the pixel position where each of the nozzles 61 discharges ink. However, when each of the nozzles 61 is at a first pixel position, a second pixel position, and a third pixel position, since ink adhered to each of the nozzles 61 is dry, each of the nozzles 61 does not discharge ink as illustrated as white spots in FIG. 1A. When each of the nozzles 61 reaches a fourth pixel position, each of the nozzles 61 starts discharging ink as illustrated as black spots in FIG. 1A. When ink on the nozzles 61 is dry, pixels onto which ink is not discharged, which are called dead pixels, generate, degrading image quality. If the letter H has dead pixels, the user may find it difficult to identify the letter H.

FIG. 1B is a schematic diagram of the HMP 20 according to the first embodiment, illustrating image formation. As described above, the HMP 20 does not record that ink has been discharged onto the pixel until each of the nozzles 61 attempts to discharge ink for the number of times N. For example, as illustrated in FIG. 1A, if the nozzles 61 do not discharge ink onto the print medium 12 until the nozzles 61 attempt to discharge ink 3 times after printing starts, the HMP 20 does not record that each of the nozzles 61 has discharged ink onto initial three pixels that are shaded in FIG. 1B. Accordingly, when printing starts, the HMP 20 determines that ink has not been discharged onto the initial three pixels over which the nozzles 61 pass initially.

As illustrated in FIG. 1B, as the user moves the HMP 20 leftward and the nozzles 61 pass over the initial three pixels that are shaded again, since the HMP 20 records that ink has not been discharged onto the initial three pixels, the HMP 20 discharges ink again. Thus, when the nozzles 61 return to the initial three pixels, the nozzles 61 discharge ink again, reducing dead pixels.

A description is provided of definition of terms used in the present disclosure.

A term "printing starts" defines that the nozzles 61 start discharging ink according to image data of a single print job. A term "when printing starts" defines a time not indicating at least an entire print time of the print job. For example, the term "when printing starts" defines a predetermined number of pixels, a predetermined time, or a predetermined distance after the nozzles 61 start discharging ink.

A term "an amount based on image data" defines an amount of ink determined to form an image according to the image data of the print job. If an amount of ink is greater than the amount based on image data, the nozzles 61 may discharge ink in the amount based on image data for a plurality of times, may discharge ink continuously onto identical pixel positions, or may discharge ink at one time in the amount of ink that is greater than the amount based on image data.

A term "discharging control" defines an operation to attempt to discharge ink and does not always define discharging of ink onto a specific position on a medium (e.g., the print medium 12).

A term "a liquid droplet discharging apparatus" defines an apparatus that discharges a discharged substance capable of being discharged at least as liquid temporarily onto a target position. Although image formation with ink is widely employed, the discharged substance is not limited to ink. Usage of the discharged substance is not limited to image formation.

A description is provided of image formation by the HMP 20.

Figure 2A:
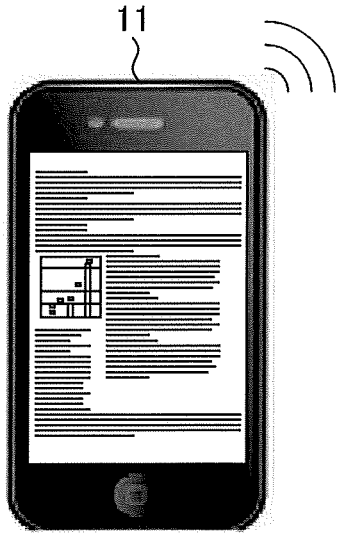
FIG. 2A is a perspective view of an image data output device.
Figure 2B:
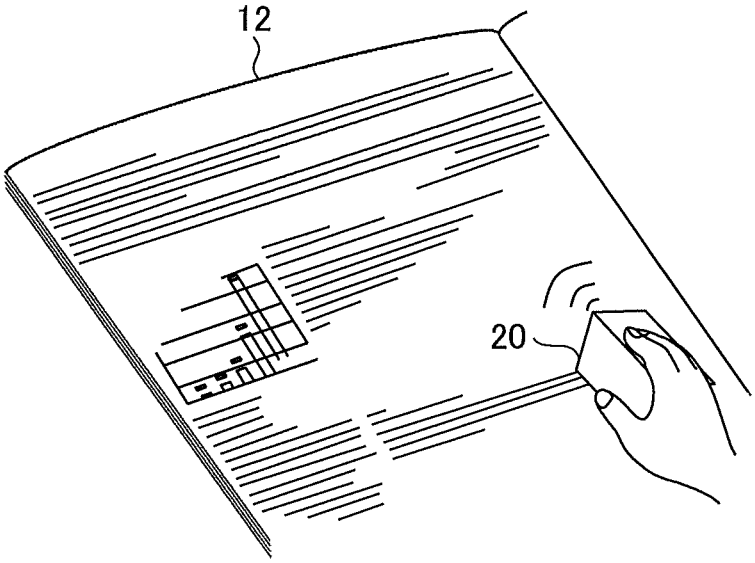
FIG. 2B is a perspective view of the HMP depicted in FIG. 1A and a print medium.

FIGS. 2A and 2B schematically illustrate image formation by the HMP 20 as one example. FIG. 2A is a perspective view of an image data output device 11. FIG. 2B is a perspective view of the HMP 20 and the print medium 12. As illustrated in FIGS. 2A and 2B, the HMP 20 receives image data sent from the image data output device 11 such as a smartphone and a personal computer (PC). The user grasps the HMP 20 and moves the HMP 20 manually and freely to scan the print medium 12 (e.g., a standard size sheet, a notebook, a corrugated cardboard, and a desk) such that the HMP 20 is not lifted above the print medium 12.

As described below, the HMP 20 includes a navigation sensor 30 and a gyroscope 31 that detect the position of the HMP 20. When the HMP 20 reaches a target discharging position, the nozzles 61 discharge ink in an appropriate color at the target discharging position. Except for a time when image formation starts, since the HMP 20 masks a position where the nozzles 61 have already discharged ink and therefore do not need to discharge ink, the user moves the HMP 20 to scan the print medium 12 in an arbitrary direction. Thus, the HMP 20 forms an image on the print medium 12.

The user moves the HMP 20 to creep over the print medium 12 such that the HMP 20 is not lifted from the print medium 12. It is preferable that the HMP 20 is not lifted from the print medium 12 to allow the navigation sensor 30 to detect a moving amount of the HMP 20 that moves with reflected light reflected by the print medium 12. If the HMP 20 is lifted from the print medium 12, the navigation sensor 30 does not detect the reflected light and therefore does not detect the moving amount of the HMP 20. If the navigation sensor 30 protrudes beyond the print medium 12, the navigation sensor 30 may not detect the reflected light due to the thickness of the print medium 12 or may detect the reflected light erroneously. To address those circumstances, the navigation sensor 30 preferably moves over and scans the print medium 12. The navigation sensor 30 and the nozzles 61 are preferably on the print medium 12 together.

A description is provided of a construction of the HMP 20.

Figure 3:
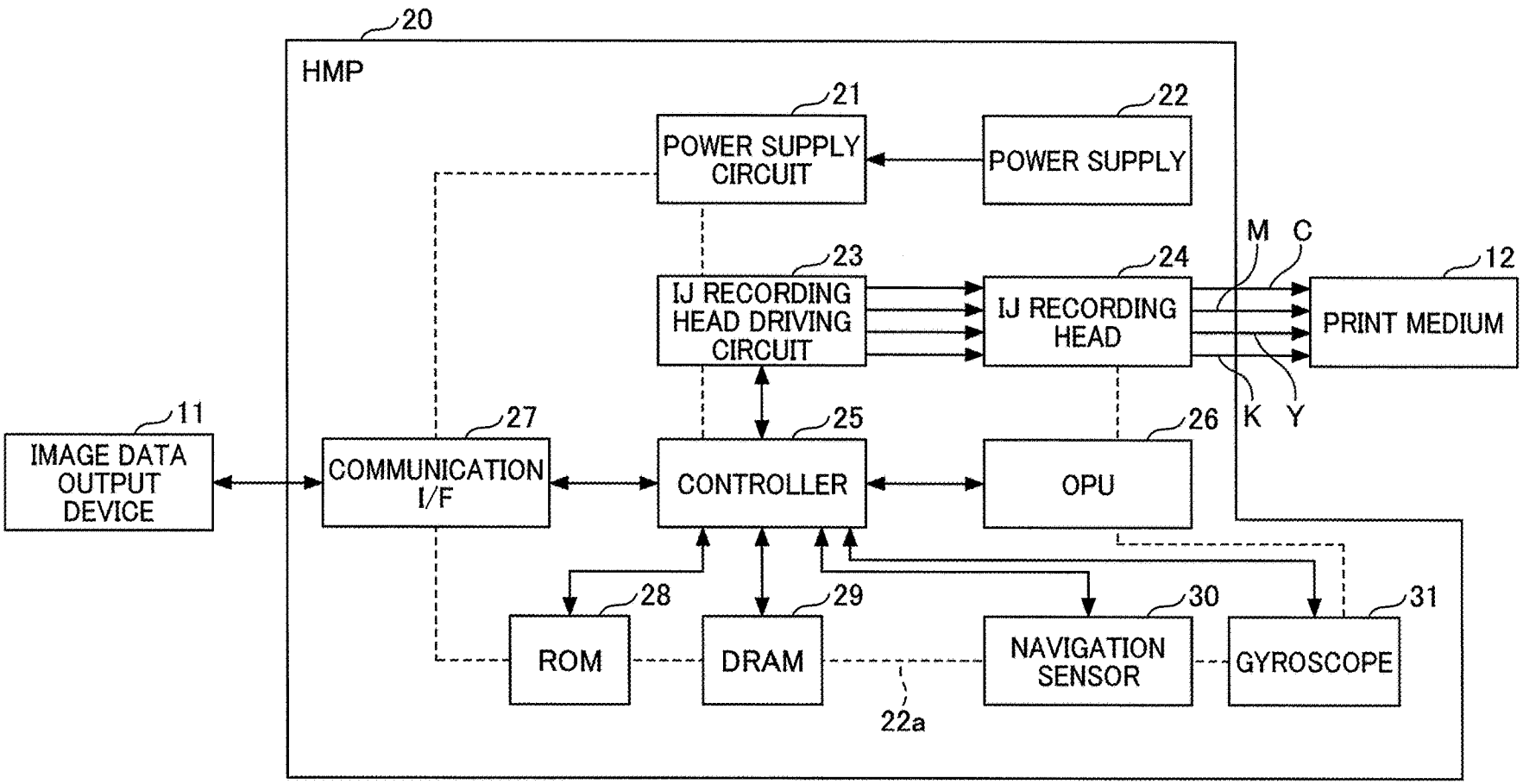
FIG. 3 is a block diagram of a hardware configuration of the HMP depicted in FIG. 2B.

FIG. 3 is a block diagram of a hardware configuration of the HMP 20 as one example. The HMP 20 is one example of a liquid droplet discharging apparatus or an image forming apparatus that forms an image on the print medium 12. A controller 25 (e.g., a processor) controls an entire operation of the HMP 20. The controller 25 is electrically connected to a communication interface (I/F) 27, an inkjet (IJ) recording head driving circuit 23, an operation panel unit (OPU) 26, a read only memory (ROM) 28, a dynamic random access memory (DRAM) 29, the navigation sensor 30, and the gyroscope 31. Since the HMP 20 is driven by power, the HMP 20 includes a power supply 22 and a power supply circuit 21. Power generated by the power supply circuit 21 is supplied to the communication I/F 27, the IJ recording head driving circuit 23, the OPU 26, the ROM 28, the DRAM 29, the IJ recording head 24, the controller 25, the navigation sensor 30, and the gyroscope 31 through a wiring 22*a* marked in a dotted line and the like.

A battery is used as the power supply 22 mainly. Alternatively, a solar battery, a commercial power supply (e.g., an alternating current power supply), a fuel cell, or the like may be used as the power supply 22. The power supply circuit 21 distributes power supplied from the power supply 22 to components of the HMP 20. The power supply circuit 21 increases and decreases the voltage of the power supply 22 to a voltage appropriate for each of the components of the HMP 20. If the power supply 22 is a chargeable battery, the power supply circuit 21 detects connection to the alternating current power supply and connects the power supply 22 to a charging circuit of the battery, causing the charging circuit to charge the power supply 22.

The communication I/F 27 receives image data from the image data output device 11 such as the smartphone and the PC. For example, the communication I/F 27 is a communication device that conforms to communications standards such as wireless local area network (LAN), Bluetooth®, near field communication (NFC), infrared communication, 3G for mobile telecommunications, and long term evolution (LTE). In addition to the wireless communications described above, the communication I/F 27 may be a communication device that conforms to cable communications using wired LAN, a universal serial bus (USB) cable, or the like.

The ROM 28 stores firmware that controls hardware of the HMP 20, driving waveform data that drives the IJ recording head 24 (e.g., data that restricts change in voltage to discharge liquid droplets), default setting data of the HMP 20, and the like.

The DRAM 29 stores image data received by the communication I/F 27 and the firmware extracted from the ROM 28. Hence, a central processing unit (CPU) 33 described below is used as a working memory to execute the firmware. The HMP 20 may incorporate a plurality of CPUs 33.

The navigation sensor 30 detects the moving amount of the HMP 20 per predetermined cyclic time. For example, the navigation sensor 30 includes a light source such as a light emitting diode (LED) and a laser and an imaging sensor that detects an image on the print medium 12. As the HMP 20 scans the print medium 12, the navigation sensor 30 detects or captures minute edges of the print medium 12 successively and analyzes a distance between the edges, thus obtaining the moving amount of the HMP 20. According to this embodiment, the single navigation sensor 30 is mounted on a bottom face of the HMP 20. Generally, two navigation sensors 30 are mounted on the bottom face of the HMP 20. However, some descriptions are provided below with reference to the HMP 20 incorporating the two navigation sensors 30 for convenience. Alternatively, the navigation sensor 30 may be a multi-axis accelerometer. In this case, the moving amount of the HMP 20 may be detected by the accelerometer only.

The gyroscope 31 is a sensor that detects the angular velocity of the HMP 20 when the HMP 20 rotates about an axis perpendicular to the print medium 12. A detailed description of a configuration of the gyroscope 31 is deferred.

The OPU 26 includes an LED that displays the status of the HMP 20 and a switch, a button, or a key with which the user instructs image formation to the HMP 20. However, the OPU 26 may have other configurations. For example, the OPU 26 may include at least one of a liquid crystal display, a touch panel, and a voice input device.

The IJ recording head driving circuit 23, using the driving waveform data described above, generates a driving waveform (e.g., a voltage) that drives the IJ recording head 24. The IJ recording head driving circuit 23 generates the driving waveform according to the size or the like of an ink droplet.

The IJ recording head 24 discharges ink (e.g., an ink droplet). FIG. 3 illustrates the IJ recording head 24 that discharges ink in four colors, that is, cyan (C), magenta (M), yellow (Y), and black (K). Alternatively, the IJ recording head 24 may discharge ink in a single color or five colors or more. The plurality of nozzles 61, serving as a discharging portion that discharges ink, is aligned in a line or two lines or more per color. The nozzles 61 discharge ink in a piezoelectric method, a thermal method, or other methods. The IJ recording head 24 is a functional component to discharge or jet liquid from the nozzles 61. Discharged liquid is not limited to particular liquid as long as the liquid has a viscosity or surface tension that allows the liquid to be discharged from the IJ recording head 24. However, preferably, the viscosity of the liquid is not greater than 30 mPa·s under ambient temperature and ambient pressure or by heating or cooling. Examples of the liquid include a solution, a suspension, or an emulsion that contains, for example, a solvent such as water and an organic solvent, a colorant such as dye and pigment, a functional material such as a polymerizable compound, a resin, and a surfactant, a biocompatible material such as deoxyribonucleic acid (DNA), amino acid, protein, and calcium, or an edible material such as a natural colorant. Such a solution, a suspension, and an emulsion are used for, e.g., inkjet ink, a surface treatment solution, a liquid for forming components of an electronic element and a light-emitting element or a resist pattern of an electronic circuit, or a material solution for three-dimensional fabrication.

The controller 25 includes the CPU 33 as described below and controls the HMP 20 entirely. Based on the moving amount of the HMP 20 detected by the navigation sensor 30 and the angular velocity of the HMP 20 detected by the gyroscope 31, the controller 25 performs determination of the position of each of the nozzles 61 of the IJ recording head 24, determination of an image to be formed according to the determined position of each of the nozzles 61, determination of activation of the nozzles 61 as described below, and the like.

A detailed description of a configuration of the controller 25 is provided below.

Figure 4:
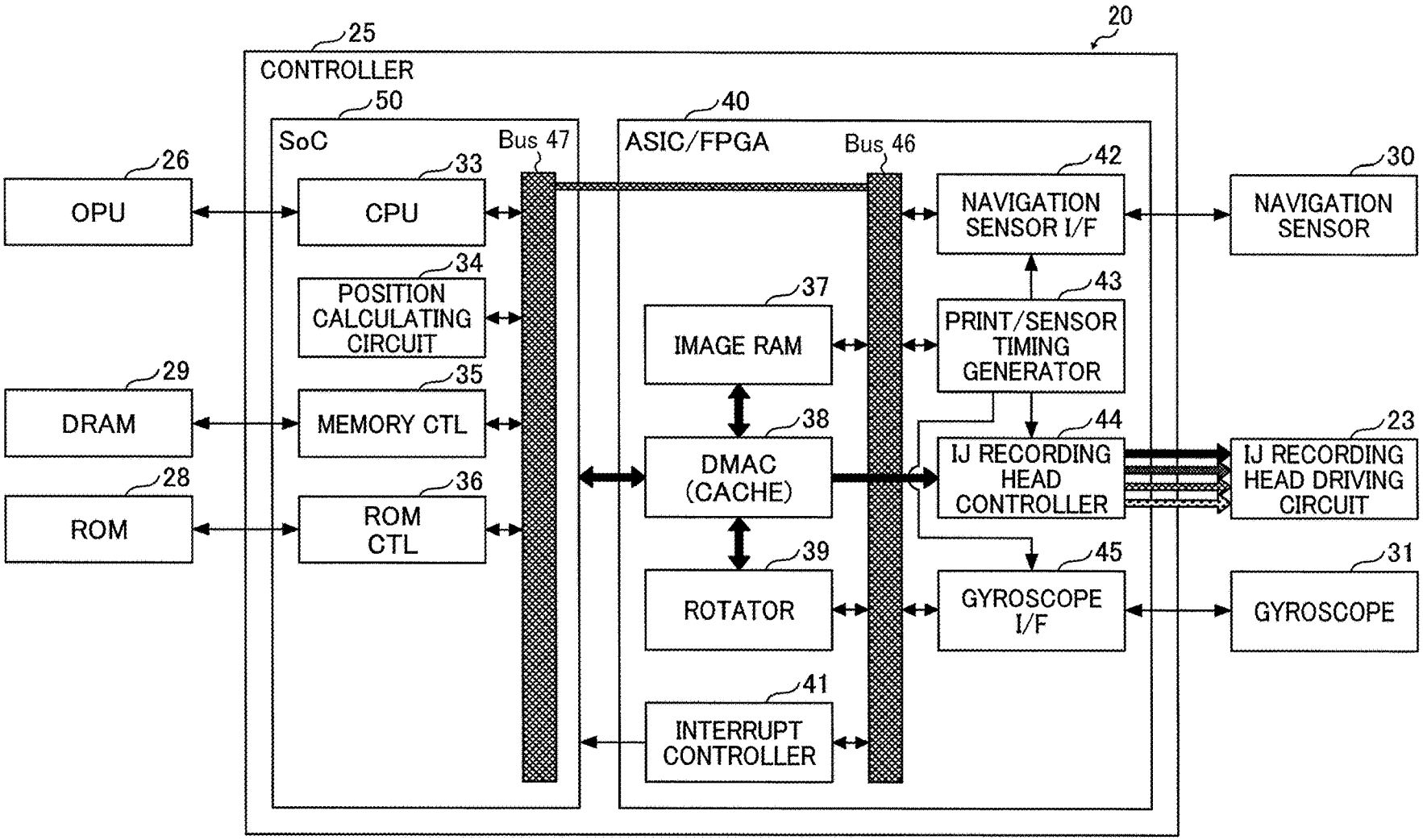
FIG. 4 is a block diagram of the HMP depicted in FIG. 3, illustrating a configuration of a controller incorporated therein.

FIG. 4 is a block diagram of the HMP 20, illustrating the configuration of the controller 25 as one example. The controller 25 includes a system-on-a-chip (SoC) 50 and an application specific integrated circuit (ASIC)/field-programmable gate array (FPGA) 40. The SoC 50 communicates with the ASIC/FPGA 40 through buses 46 and 47. The ASIC/FPGA 40 is designed by an implementation technology of either ASIC or FPGA. Alternatively, the ASIC/FPGA 40 may be replaced with a device designed by implementation technologies other than ASIC and FPGA. The SoC 50 and the ASIC/FPGA 40 may not be separate chips, respectively, and may be combined into a single chip and a single substrate. Alternatively, the SoC 50 and the ASIC/FPGA 40 may be three or more chips and substrates.

The SoC 50 includes the CPU 33, a position calculating circuit 34, a memory controller (CTL) 35, and a ROM controller (CTL) 36, which are connected to each other through the bus 47. Alternatively, the SoC 50 may include other components.

The ASIC/FPGA 40 includes an image random access memory (RAM) 37, a direct memory access controller (DMAC) 38, a rotator 39, an interrupt controller 41, a navigation sensor interface (I/F) 42, a print/sensor timing generator 43, an inkjet (IJ) recording head controller 44, and a gyroscope interface (I/F) 45, which are connected to each other through the bus 46. Alternatively, the ASIC/FPGA 40 may include other components.

The CPU 33 executes firmware (e.g., a program) and the like extracted from the ROM 28 to the DRAM 29 and controls operation of the position calculating circuit 34, the memory CTL 35, and the ROM CTL 36, which are disposed inside the SoC 50. The CPU 33 also controls operation of the image RAM 37, the DMAC 38, the rotator 39, the interrupt controller 41, the navigation sensor I/F 42, the print/sensor timing generator 43, the TJ recording head controller 44, the gyroscope I/F 45, and the like, which are disposed inside the ASIC/FPGA 40.

The position calculating circuit 34 calculates the position (e.g., coordinate information) of the HMP 20 based on the moving amount of the HMP 20 per sampling cycle, which is detected by the navigation sensor 30 and the angular velocity of the HMP 20 per sampling cycle, which is detected by the gyroscope 31. Although the position of the HMP 20 is the position of the nozzle 61 exactly, if the position of the navigation sensor 30 is identified, the position calculating circuit 34 calculates the position of the nozzle 61. According to this embodiment, the position of the nozzle 61 is identified as the position of the HMP 20 unless otherwise noted. The position calculating circuit 34 calculates a target discharging position. Alternatively, the CPU 33 may attain the position calculating circuit 34 on software basis.

The position calculating circuit 34 calculates the position of the nozzle 61 based on a predetermined start point as described below, for example, a default position of the HMP 20 when image formation starts. The position calculating circuit 34 estimates a moving direction and acceleration of the HMP 20 based on a difference between a past position and a last position, thus estimating a position of the navigation sensor 30 when the nozzle 61 discharges ink next time, for example. Thus, the nozzle 61 discharges ink while suppressing delay in discharging ink after the user moves the HMP 20 to scan the print medium 12.

The memory CTL 35 is an interface with the DRAM 29. The memory CTL 35 requests the DRAM 29 for data, sends obtained firmware to the CPU 33, and sends obtained image data to the ASIC/FPGA 40.

The ROM CTL 36 is an interface with the ROM 28. The ROM CTL 36 requests the ROM 28 for data and sends the obtained data to the CPU 33 and the ASIC/FPGA 40.

The rotator 39 rotates image data obtained by the DMAC 38 according to the IJ recording head 24 that discharges ink, the position of the nozzle 61 inside the IJ recording head 24, and inclination of the IJ recording head 24 caused by installation error or the like. The DMAC 38 outputs image data after rotation to the IJ recording head controller 44.

The image RAM 37 temporarily stores the image data obtained by the DMAC 38. That is, the image RAM 37 performs buffering on a certain amount of image data and retrieves the image data according to the position of the HMP 20.

The IJ recording head controller 44 performs dithering and the like on the image data (e.g., bitmap data) and converts the image data into an aggregation of dots that represent an image with the size and the density of the dots. Thus, the image data is converted into data defining the position of pixel and the size of dot. The IJ recording head controller 44 outputs a control signal corresponding to the size of dot to the IJ recording head driving circuit 23. The IJ recording head driving circuit 23, using the driving waveform data described above that corresponds to the control signal, generates a driving waveform (e.g., a voltage) that drives the IJ recording head 24.

The navigation sensor I/F 42 communicates with the navigation sensor 30, receives a moving amount (ΔX, ΔY') described below as information from the navigation sensor 30, and stores the moving amount (ΔX', ΔY') in an internal register.

The print/sensor timing generator 43 notifies a reading time when the navigation sensor I/F 42 and the gyroscope I/F 45 read information and notifies the IJ recording head controller 44 of a driving time. A cycle of the time when the navigation sensor I/F 42 and the gyroscope I/F 45 read information is greater than a cycle of the time when the nozzle 61 discharges ink. The IJ recording head controller 44 determines activation of the nozzle 61. If the IJ recording head controller 44 identifies the target discharging position to which the nozzle 61 is requested to discharge ink, the IJ recording head controller 44 causes the nozzle 61 to discharge ink. Conversely, if the IJ recording head controller 44 does not identify the target discharging position, the IJ recording head controller 44 does not cause the nozzle 61 to discharge ink.

At the reading time defined by the print/sensor timing generator 43, the gyroscope I/F 45 obtains the angular velocity detected by the gyroscope 31 and stores the obtained angular velocity in a resister.

When the interrupt controller 41 detects that the navigation sensor I/F 42 completes communication with the navigation sensor 30, the interrupt controller 41 outputs an interrupt signal that notifies the SoC 50 of completion of communication. Upon reception of the interrupt signal, the CPU 33 obtains the moving amount (ΔX', ΔY') stored in the internal register of the navigation sensor I/F 42. Additionally, the CPU 33 also notifies a status such as an error. Similarly, with respect to the gyroscope I/F 45, the interrupt controller 41 outputs an interrupt signal that notifies the SoC 50 of completion of communication with the gyroscope 31.

A detailed description is now given of a configuration of the gyroscope 31.

Figure 5:
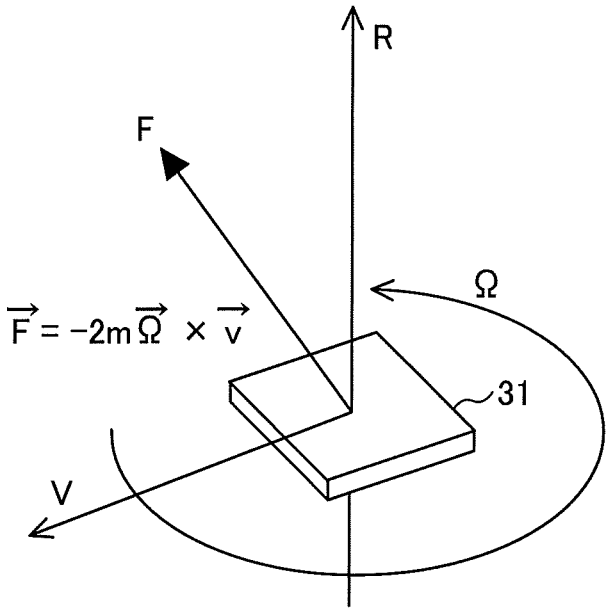
FIG. 5 is a diagram of a gyroscope incorporated in the HMP depicted in FIG. 4.

FIG. 5 is a diagram of the gyroscope 31, illustrating a principle of the gyroscope 31 to detect the angular velocity as one example. As a moving object rotates, a Coriolis force F generates in a direction perpendicular to both a moving direction V of the moving object and a rotation axis R.

In order to move the moving object, the gyroscope 31 vibrates a micro electro mechanical systems (MEMS) element to generate a velocity v (e.g., a vector). As rotation at an angular velocity Ω (e.g., a vector) is applied to the MEMS element having a mass m and vibrating from outside, the Coriolis force F is applied to the MEMS element. The Coriolis force F is defined by a formula (1) below.

$$F=-2m\Omega\times v \quad (1)$$

× represents outer product of the vector. As described above, the direction of the Coriolis force F is perpendicular to the moving direction V of the moving object and the rotation axis R. For example, the MEMS element has an electrode that has a comb teeth structure. The gyroscope 31 recognizes a displacement of the moving object by the Coriolis force F as a change in an electrostatic capacity. A signal of the Coriolis force F is amplified in the gyroscope 31, filtered, and then calculated and output into an angular velocity. That is, since the Coriolis force F, the mass m, and the velocity v are known, the angular velocity Ω is retrieved.

A description is provided of a configuration of the navigation sensor 30.

Figure 6:
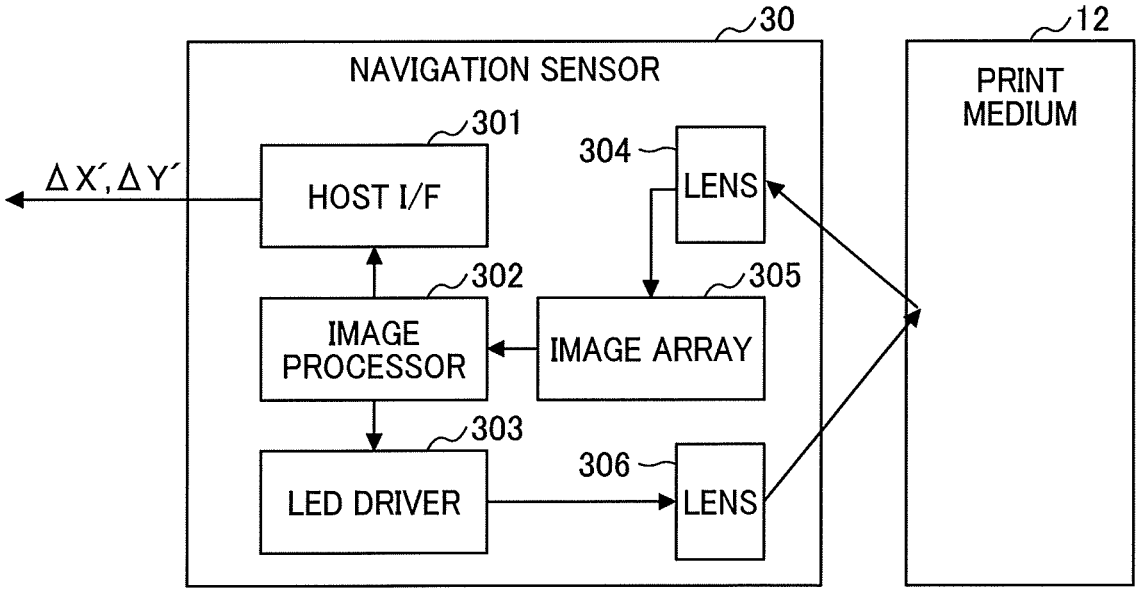
FIG. 6 is a block diagram of a hardware configuration of a navigation sensor incorporated in the HMP depicted in FIG. 4.

FIG. 6 is a block diagram of a hardware configuration of the navigation sensor 30 as one example. FIG. 6 illustrates a surface of paper as the print medium 12. The navigation sensor 30 includes a host interface (I/F) 301, an image processor 302, a light emitting diode (LED) driver 303, two lenses 304 and 306, and an image array 305. The LED driver 303 is a combination of an LED and a control circuit. The LED driver 303 emits LED light according to a command from the image processor 302. The image array 305 receives reflected light, that is, the LED light reflected by the print medium 12, through the lens 304. The two lenses 304 and 306 are disposed at positions where the lenses 304 and 306 are optically focused with respect to the surface of the print medium 12.

The image array 305 includes a photo diode that has sensitivity to a wavelength of the LED light. The image array 305 generates image data based on the received LED light. The image processor 302 obtains the image data and calculates a moving distance, that is, the moving amount (ΔX', ΔY'), of the navigation sensor 30 based on the image data. The image processor 302 outputs the calculated moving distance to the controller 25 through the host I/F 301.

The LED used as a light source is advantageous if the print medium 12 has a rough surface, for example, if the print medium 12 is paper. Since the rough surface of the print medium 12 generates a shadow, the image processor 302 calculates the moving distance of the navigation sensor 30 in X-direction and Y-direction precisely based on the shadow as a characteristic mark. Conversely, if the print medium 12 has a smooth surface or is transparent, a semiconductor laser diode (LD) that generates a laser beam is used as a light source. The semiconductor LD forms a stripe pattern or the like on the print medium 12, for example, thus producing a characteristic mark. The image processor 302 calculates the moving distance of the navigation sensor 30 precisely based on the characteristic mark.

Figure 7:
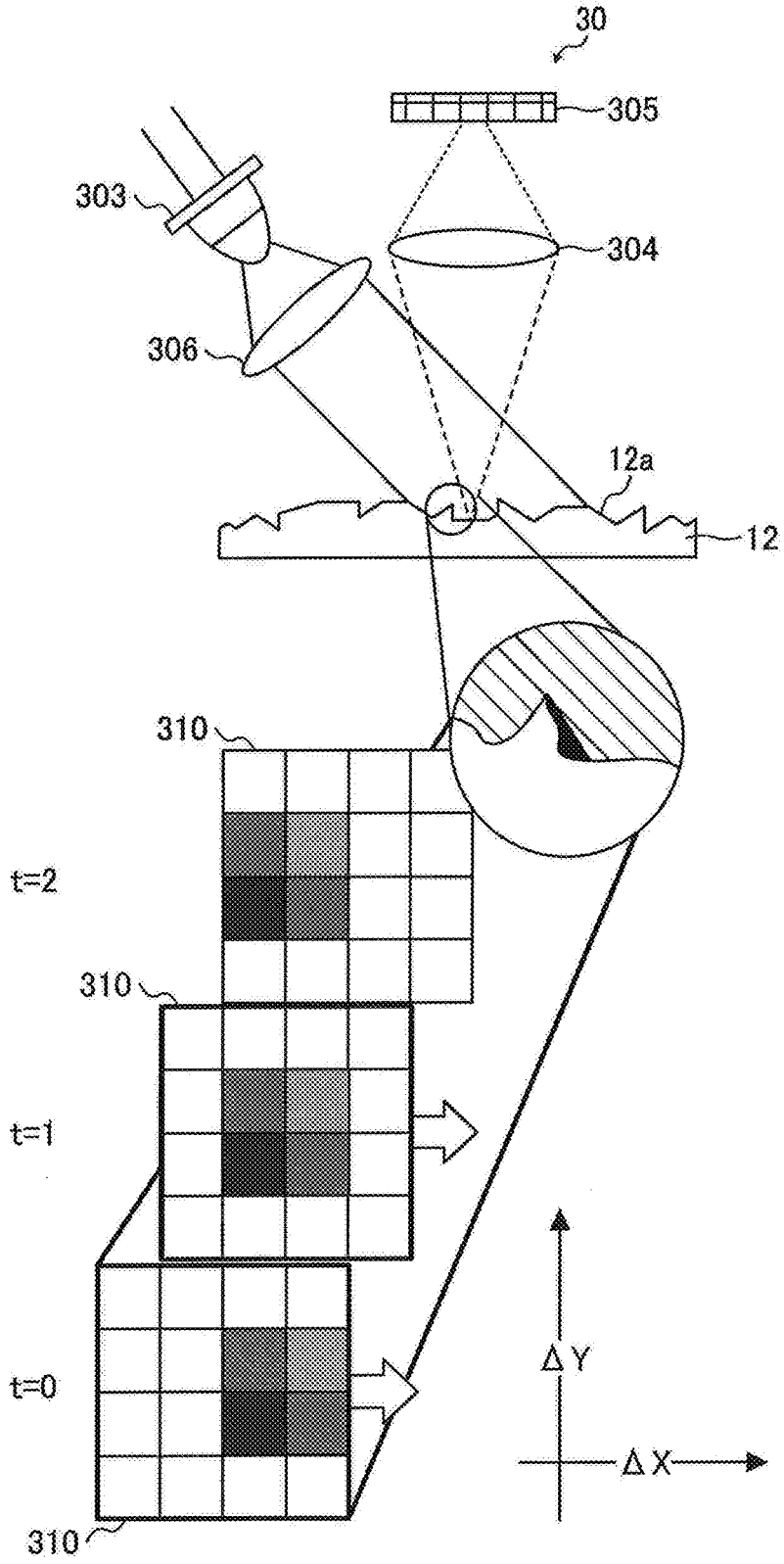
FIG. 7 is a diagram of the navigation sensor depicted in FIG. 6, illustrating a method for detecting a moving amount of the HMP.

Referring to FIG. 7, a description is provided of an operation of the navigation sensor 30.

FIG. 7 is a diagram of the navigation sensor 30, illustrating a method for detecting the moving amount of the HMP 20. Light emitted from the LED driver 303 irradiates a surface 12*a* of the print medium 12 through the lens 306. As illustrated in FIG. 7, the surface 12*a* of the print medium 12 has slight asperities of various shapes that create shadows of various shapes.

The image processor 302 receives reflected light through the lens 304 and the image array 305 per predetermined sampling time, thus obtaining image data 310. The image processor 302 converts the image data 310 created as illustrated in FIG. 7 into a matrix per predetermined resolution. For example, the image processor 302 divides the image data 310 into a plurality of rectangular regions. The image processor 302 compares the image data 310 obtained at a previous sampling time with the image data 310 obtained at a present sampling time. The image processor 302 detects the number of the rectangular regions over which the image data 310 moves and calculates the number of the rectangular regions as a moving distance of the HMP 20. If the HMP 20 moves in ΔX-direction in FIG. 7, as the image data 310 at a time t=0 is compared with the image data 310 at a time t=1, an image on a right end under the time t=0 coincides with an image on a center under the time t=1. Since the image moves in −ΔX-direction, the HMP 20 has moved by a single cell in ΔX-direction. The image moves similarly under comparison between the time t=1 and a time t=2.

A description is provided of a configuration of the IJ recording head driving circuit 23.

Figure 8:
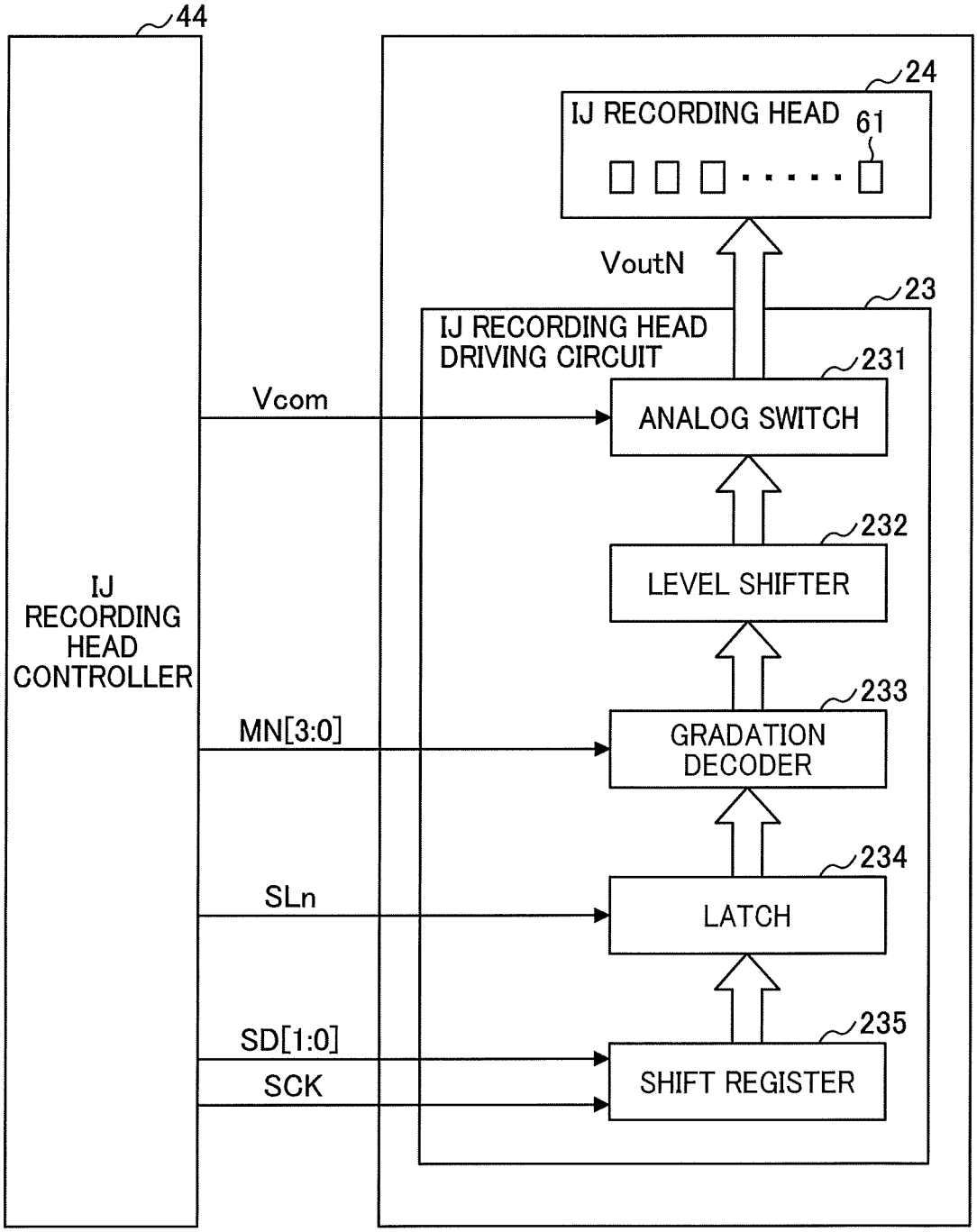
FIG. 8 is a block diagram of an inkjet (IJ) recording head driving circuit incorporated in the HMP depicted in FIG. 4.

FIG. 8 is a block diagram of the IJ recording head driving circuit 23 as one example. The IJ recording head 24 includes the plurality of nozzles 61. Each of the nozzles 61 includes an actuator. The actuator employs the thermal method or the piezoelectric method. In the thermal method, ink inside the nozzle 61 is heated and expanded. The expanded ink is discharged from the nozzle 61 as an ink droplet. In the piezoelectric method, a piezoelectric element presses against a wall of the nozzle 61 to squeeze out ink inside the nozzle 61 as an ink droplet.

The IJ recording head driving circuit 23 includes an analog switch 231, a level shifter 232, a gradation decoder 233, a latch 234, and a shift register 235. The IJ recording head controller 44 transfers image data SD as serial data corresponding to the number of the nozzles 61 (e.g., the actuators) of the IJ recording head 24 to the shift register 235 of the IJ recording head driving circuit 23 through an image data transfer clock SCK.

When the transfer finishes, the IJ recording head controller 44 stores each of the image data SD in the latch 234 allocated to each of the nozzles 61 through an image data latch signal SLn.

After latching the image data SD, the IJ recording head controller 44 outputs a head driving waveform Vcom, which causes each of the nozzles 61 to discharge an ink droplet of each gradation value, to the analog switch 231. The IJ recording head controller 44, which sends a head driving mask pattern MN as a gradation control signal to the gradation decoder 233, transits the head driving mask pattern MN such that the head driving mask pattern MN is selected in accordance with a driving waveform time.

The gradation decoder 233 performs logical operation on the gradation control signal and the latched image data. The level shifter 232 increases a logical level voltage signal obtained by logical operation to a voltage level that drives the analog switch 231.

The analog switch 231 receives the increased voltage signal and is turned on and off, thus varying a driving waveform VoutN to be sent to the actuator of the IJ recording head 24 for each of the nozzles 61. The IJ recording head 24 causes the nozzles 61 to discharge ink droplets according to the driving waveform VoutN, forming an image on the print medium 12.

The configuration and operation of the IJ recording head driving circuit 23 illustrated in FIG. 8 are employed by inkjet printers. Alternatively, configurations other than the configuration illustrated in FIG. 8 may be installed in the HMP 20 as long as the configurations discharge ink droplets.

Figure 9A:
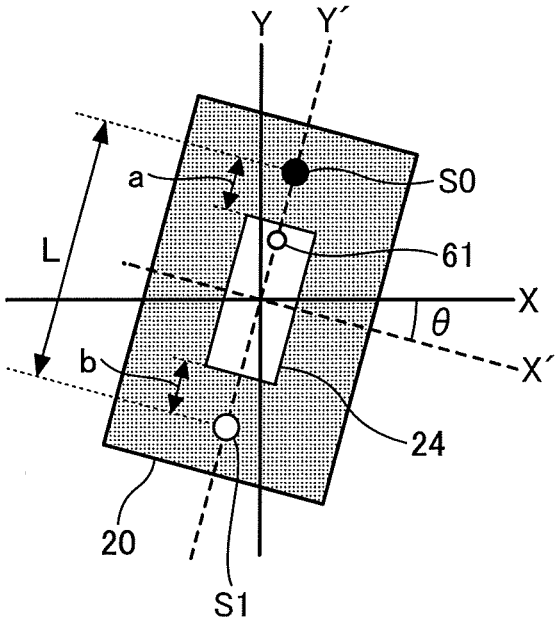
FIG. 9A is a plan view of the HMP depicted in FIG. 1A.
Figure 9B:
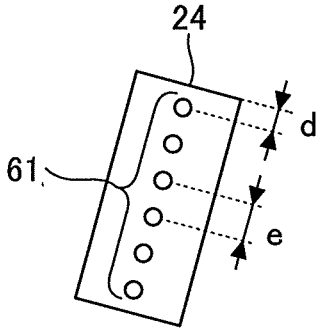
FIG. 9B is a diagram of an IJ recording head incorporated in the HMP depicted in FIG. 9A.

Referring to FIGS. 9A and 9B, a description is provided of the position and the like of the nozzle 61 of the IJ recording head 24.

FIG. 9A is a plan view of the HMP 20 as one example. FIG. 9B is a diagram of the IJ recording head 24 as one example. FIGS. 9A and 9B illustrate an opposed face of the IJ recording head 24, which faces the print medium 12.

According to this embodiment, the HMP 20 includes a single navigation sensor S0. However, FIG. 9A also illustrates another navigation sensor S1 that is provided if the HMP 20 incorporates the two navigation sensors 30 for convenience to illustrate positions of the two navigation sensors 30. If the HMP 20 incorporates the two navigation sensors 30, a distance L (e.g., an interval) is provided between the two navigation sensors S0 and S1. The greater the distance L, the better. As the distance L increases, a minimum rotation angle θ that is detectable decreases, thus reducing error in detecting the position of the HMP 20.

A distance a (e.g., an interval) is provided between the navigation sensor S0 and the IJ recording head 24. A distance b (e.g., an interval) is provided between the navigation sensor S1 and the IJ recording head 24. The distance a may be equivalent to the distance b. Alternatively, each of the distance a and the distance b may be zero so that the navigation sensors S0 and S1 contact the IJ recording head 24. If the HMP 20 incorporates the single navigation sensor 30, the navigation sensor S0 is situated at an arbitrary position around the IJ recording head 24. Hence, FIG. 9A illustrates the position of the navigation sensor S0 as one example. The navigation sensor S0 situated at the position depicted in FIG. 9A defines the shortened distance a between the navigation sensor S0 and the IJ recording head 24, facilitating downsizing of the bottom face of the HMP 20.

As illustrated in FIG. 9B, a distance d (e.g., an interval) is provided between an edge of the IJ recording head 24 and the nozzle 61 disposed in proximity to the edge of the IJ recording head 24. A distance e (e.g., an interval) is provided between the adjacent nozzles 61. The ROM 28 or the like prestores the distances a, b, d, and e.

If the position calculating circuit 34 or the like calculates the position of the navigation sensor S0, the position calculating circuit 34 calculates the position of the nozzle 61 based on the distances a, b (optionally), d, and e.

A description is provided of the position of the HMP 20 relative to the print medium 12.

Figure 10A:
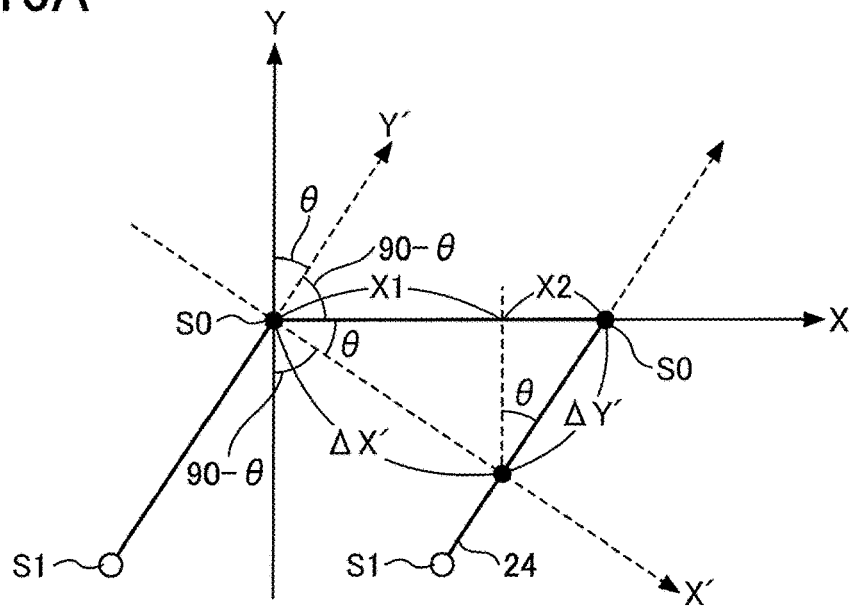
FIG. 10A is a diagram of a coordinate system of the HMP depicted in FIG. 9A for describing X-coordinate.
Figure 10B:
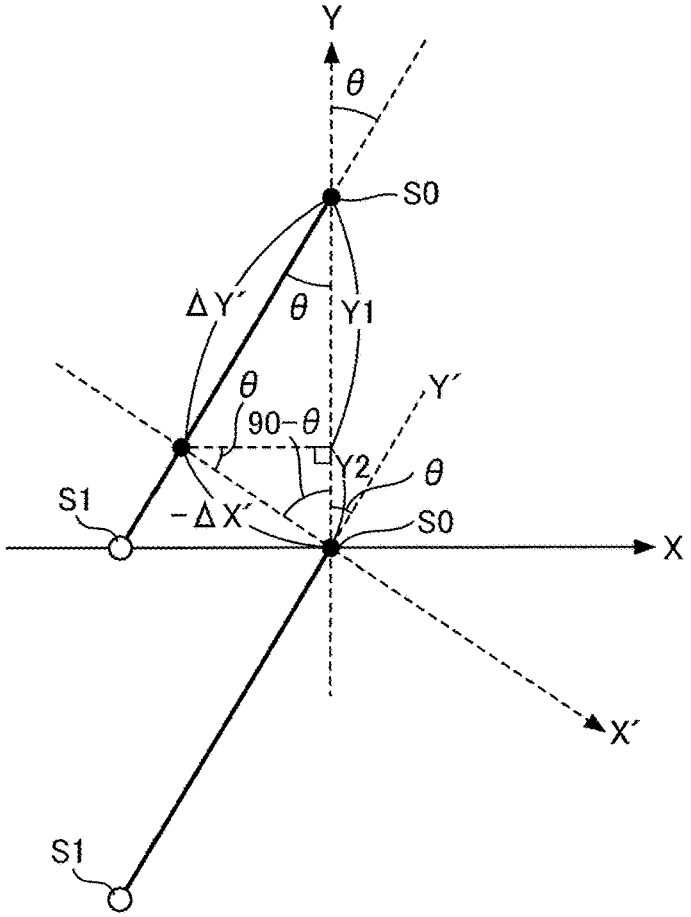
FIG. 10B is a diagram of the coordinate system of the HMP depicted in FIG. 9A for describing Y-coordinate.

FIGS. 10A and 10B illustrate diagrams of a coordinate system of the HMP 20 and a method for calculating the position of the HMP 20 as one example. According to this embodiment, X-axis defines a direction horizontal to the print medium 12. Y-axis defines a direction perpendicular to the print medium 12. An origin defines the position of the navigation sensor S0 when image formation starts. Such coordinates are hereinafter referred to as print medium coordinates. Conversely, the navigation sensor S0 outputs the moving amount of the HMP 20 on coordinates defined by X'-axis and Y'-axis depicted in FIGS. 10A and 10B. For example, the navigation sensor S0 outputs the moving amount (ΔX', ΔY') on the coordinates in which Y'-axis represents an alignment direction in which the nozzles 61 are aligned and X'-axis represents a direction perpendicular to the Y'-axis.

A description is provided of an example in which the HMP 20 rotates clockwise by the rotation angle θ with respect to the print medium 12 as illustrated in FIG. 10A.

It is difficult for the user to move the HMP 20 to scan the print medium 12 without tilting the HMP 20 relative to the print medium coordinates. Hence, the rotation angle θ may not be zero. If the HMP 20 does not rotate, X-axis is equal to X'-axis and Y-axis is equal to Y'-axis. Conversely, if the HMP 20 rotates by the rotation angle θ relative to the print medium 12, an output of the navigation sensor S0 does not coincide with an actual position of the HMP 20 relative to the print medium 12. The rotation angle θ is positive clockwise in FIGS. 10A and 10B. X-axis and X'-axis are positive rightward in FIGS. 10A and 10B. Y-axis and Y'-axis are positive upward in FIGS. 10A and 10B.

FIG. 10A is a diagram of the coordinate system of the HMP 20 for describing X-coordinate as one example. FIG. 10A illustrates a relation between the moving amount (ΔX', ΔY') detected by the navigation sensor S0 and X-axis and Y-axis when the HMP 20 moves in X-direction at the rotation angle θ constantly. If the HMP 20 incorporates the two navigation sensors 30, since the position of the navigation sensor S0 relative to the navigation sensor S1 is fixed, the two navigation sensors S0 and S1 output an identical moving amount. The navigation sensor S0 defines a distance X1+X2 on X-coordinate obtained by adding a distance X2 to a distance X1. The distance X1+X2 is calculated based on the moving amount (ΔX', ΔY') and the rotation angle θ.

FIG. 10B illustrates a relation between the moving amount (ΔX', ΔY') detected by the navigation sensor S0 and X-axis and Y-axis when the HMP 20 moves in Y-direction at the rotation angle θ constantly. The navigation sensor S0 defines a distance Y1+Y2 on Y-coordinate obtained by adding a distance Y2 to a distance Y1. The distance Y1+Y2 is calculated based on a moving amount (−ΔX', ΔY') and the rotation angle θ.

Accordingly, if the HMP 20 moves in X-direction and Y-direction while retaining the rotation angle θ, the moving amount (ΔX', ΔY') output by the navigation sensor S0 is converted on X-axis and Y-axis of the print medium coordinates as defined by formulas (2) and (3) below.

$$X=\Delta X' \cos\theta+\Delta Y' \sin\theta \quad (2)$$

$$Y=-\Delta X' \sin\theta+\Delta Y' \cos\theta \quad (3)$$

A description is provided of detection of the rotation angle θ.

According to this embodiment, the position calculating circuit 34 calculates the rotation angle θ based on an output of the gyroscope 31. The gyroscope 31 outputs the angular velocity Ω. The angular velocity Ω is defined by a formula (4) below.

$$\Omega=d\theta/dt \quad (4)$$

Accordingly, if dt represents a sampling cycle, a rotation angle dθ is defined by a formula (5) below.

$$d\theta=\Omega\times dt \quad (5)$$

Accordingly, the rotation angle θ at present defined by a time t in a range of from 0 to N is defined by a formula (6) below.

$$\theta=\sum_{t=0}^{N}\omega i\times dt \quad (6)$$

Thus, the gyroscope 31 calculates the rotation angle θ. As defined by the formulas (2) and (3), the position of the HMP 20 is calculated based on the rotation angle θ. If the position calculating circuit 34 calculates the position of the navigation sensor S0, the position calculating circuit 34 calculates the coordinates of each of the nozzles 61 based on the distances a, b (optionally), d, and e depicted in FIGS. 9A and 9B. Each of a value of X-axis defined by the formula (2) and a value of Y-axis defined by the formula (3) indicates an amount of change per sampling cycle. Accordingly, the position calculating circuit 34 calculates the present position of the HMP 20 by accumulating the values of X-axis and Y-axis.

If the HMP 20 incorporates the two navigation sensors 30, the position calculating circuit 34 calculates the rotation angle θ based on the moving amount ΔX' of the two navigation sensors 30 according to a formula (7) below.

$$d\theta=\arcsin\{(\Delta X'0-\Delta X'1)/L\} \quad (7)$$

ΔX'0 represents a moving amount of the navigation sensor S0 in X'-direction. ΔX' 1 represents a moving amount of the navigation sensor S1 in X'-direction. L represents a distance between the navigation sensors S0 and S1.

Figure 11:
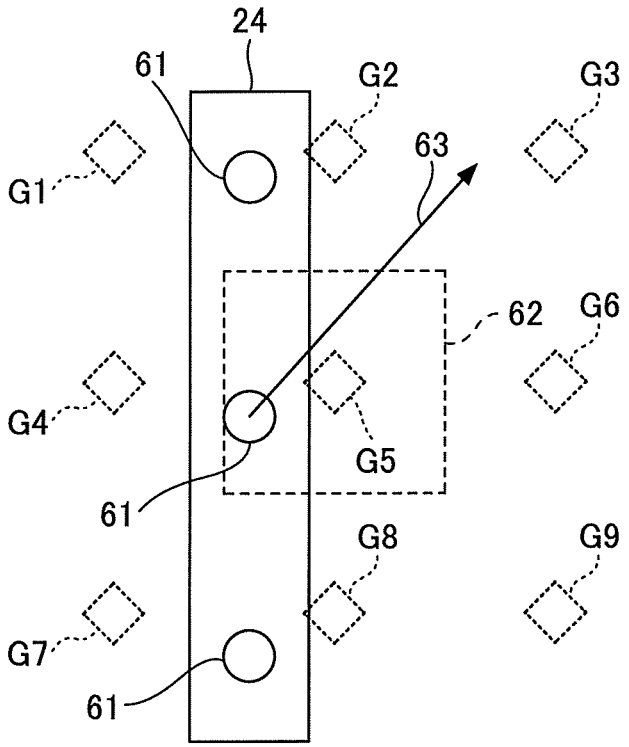
FIG. 11 is a diagram of the IJ recording head depicted in FIG. 9B for describing a relation between a target discharging position and a position of a nozzle incorporated in the IJ recording head.

Referring to FIG. 11, a description is provided of the target discharging position.

FIG. 11 is a diagram of the IJ recording head 24 for describing a relation between the target discharging position and the position of the nozzle 61 as one example. In FIG. 11, target discharging positions G1 to G9 are target positions onto which the nozzles 61 of the HMP 20 discharge ink or pixels are formed. The target discharging positions G1 to G9 are calculated based on the default position of the HMP 20 and resolutions X dpi and Y dpi of the HMP 20 in X-direction and Y-direction, respectively.

For example, if the resolution is 300 dpi, the target discharging positions G1 to G9 are set per about 0.084 mm in a longitudinal direction of the IJ recording head 24 and a direction perpendicular to the longitudinal direction of the IJ recording head 24. If pixels onto which ink is to be discharged are at the target discharging positions G1 to G9, the HMP 20 discharges ink.

However, it is practically difficult to capture a time when the nozzles 61 overlap the target discharging positions precisely. To address this circumstance, an allowable error 62 is provided between the target discharging position and the present position of the nozzle 61. When the present position of the nozzle 61 is within the allowable error 62 from the target discharging position, the nozzle 61 discharges ink. Setting of the allowable error 62 is called determining activation of the nozzle 61 or identifying the nozzle 61 that is allowed to discharge ink.

As illustrated with an arrow 63, the HMP 20 monitors the moving direction and acceleration of the nozzle 61, estimating a position of the nozzle 61 where the nozzle 61 discharges ink next time. Accordingly, the position calculating circuit 34 compares the estimated position of the nozzle 61 with the allowable error 62, causing the nozzle 61 to be ready for discharging ink.

A description is provided of functions of the HMP 20.

Figure 12:
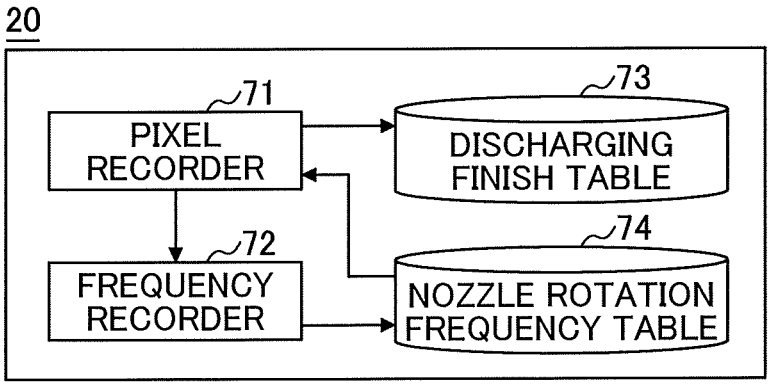
FIG. 12 is a block diagram of the HMP depicted in FIG. 4, illustrating functions of the HMP.

FIG. 12 is a block diagram of the HMP 20, illustrating the functions of the HMP 20 according to this embodiment as one example. As illustrated in FIG. 12, the HMP 20 includes a pixel recorder 71 and a frequency recorder 72. Each of the pixel recorder 71 and the frequency recorder 72 is a function, a functional component, or means achieved as the CPU 33 of the HMP 20 executes a program stored in the ROM 28. The HMP 20 further includes a discharging finish table 73 and a nozzle rotation frequency table 74. The DRAM 29 depicted in FIG. 3, the image RAM 37 depicted in FIG. 4, or the like establishes the discharging finish table 73 and the nozzle rotation frequency table 74.

After the nozzle 61 discharges ink droplets for the number of times N after printing starts, the pixel recorder 71 records that pixels, onto which the nozzle 61 has discharged the ink droplets, bear ink. In order to determine whether the nozzle 61 has discharged the ink droplets for the number of times N, the pixel recorder 71 refers to the nozzle rotation frequency table 74. In other words, when printing starts, until the nozzle 61 discharges ink droplets for the number of times N, the pixel recorder 71 does not record a pixel position.

The discharging finish table 73 records whether the nozzle 61 has discharged an ink droplet onto a pixel defined by image data for printing.

The discharging finish table 73 contains information that prevents the IJ recording head controller 44 from causing the nozzle 61 to perform repeated discharging, that is, to discharge ink droplets onto an identical pixel repeatedly. Information that prevents repeated discharging is not limited as long as the information indicates, for each pixel, that the pixel is finished with recording, that is, the pixel bears ink.

A description is provided of a first method and a second method for writing information back to the DRAM 29 per pixel as examples.

The first method is to clear memory of image data according to which the nozzle 61 has finished recording, that is, the nozzle 61 has discharged ink droplets. The second method is to record information indicating that the nozzle 61 has finished recording separately from image data. The first method rewrites original image data as non-discharging data. That is, the first method clears the memory.

The second method records, per pixel, data corresponding to a region in which recording is finished separately from original image data.

In the first method, the memory CTL 35 reads original image data only, decreasing a memory access load. Additionally, the memory CTL 35 only reads and writes relevant image data, suppressing the number of times of memory access.

Conversely, in the second method, the memory CTL 35 reads both original image data and data indicating that recording has finished (e.g., the discharging finish table 73), increasing a memory load. However, since memory data of the original image data is not broken, desired processing is performed according to the original image data. For example, the desired processing is to distinguish a text region from a graphic region and perform some processing or the like. Additionally, when printing on a plurality of pages, the original image data is reused.

According to this embodiment, since the HMP 20 reuses original image data, the second method is preferable.

The frequency recorder 72 records, per the nozzle 61, the number of times of discharging of ink performed by the nozzle 61. The nozzle rotation frequency table 74 records the number of times when the nozzle 61 has discharged ink, which corresponds to each of the nozzles 61. The nozzle rotation frequency table 74 records the number of times when the nozzle 61 has attempted to discharge ink, not the number of times when the nozzle 61 has discharged ink actually. The number of times when the nozzle 61 has discharged ink, which is recorded, is not greater than N.

A description is provided of recording of pixels onto which the nozzle 61 has discharged ink.

Figure 13:
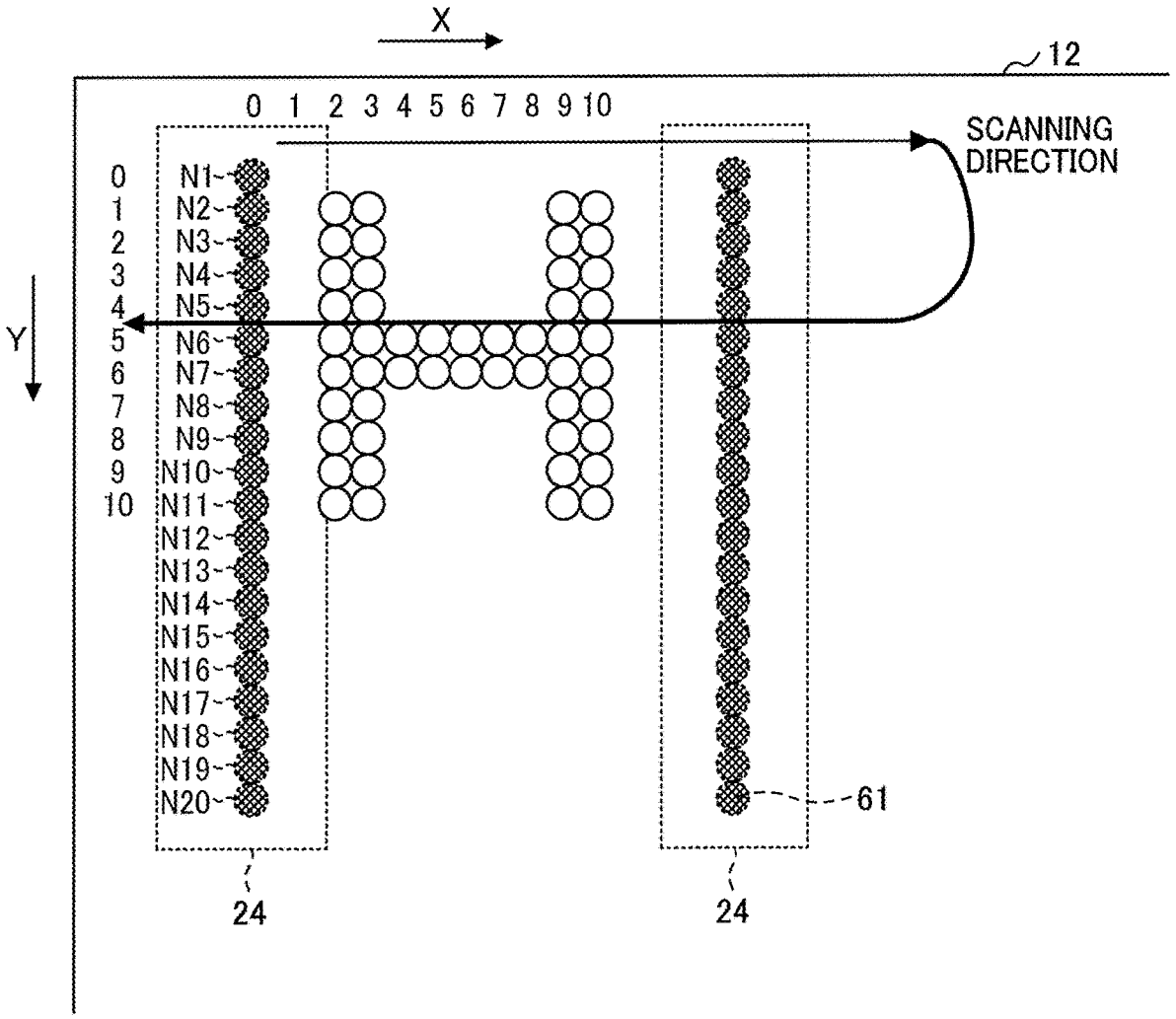
FIG. 13 is a diagram of the IJ recording head depicted in FIG. 11 and the print medium, illustrating pixels onto which the nozzle discharges ink.

Specifically, referring to FIG. 13, a description is provided of a relation between a pixel onto which the nozzle 61 has attempted to discharge ink and the nozzle 61.

FIG. 13 is a diagram of the IJ recording head 24 and the print medium 12, illustrating pixels onto which the nozzle 61 discharges ink as one example. FIG. 13 illustrates the nozzles 61 assigned with reference numerals N1 to N20. The user moves the HMP 20 to scan the print medium 12 rightward horizontally in FIG. 13. Pixels are defined on coordinates (x, y) as below.

Nozzle N1 is outside the allowable error 62 for the pixels.

Nozzle N2 is within the allowable error 62 defined by (2, 1), (3, 1), (9, 1), and (10, 1).

Nozzle N3 is within the allowable error 62 defined by (2, 2), (3, 2), (9, 2), and (10, 2).

Nozzle N4 is within the allowable error 62 defined by (2, 3), (3, 3), (9, 3), and (10, 3).

Nozzle N5 is within the allowable error 62 defined by (2, 4), (3, 4), (9, 4), and (10, 4).

Nozzle N6 is within the allowable error 62 defined by (2, 5), (3, 5), (4, 5), and (5, 5).

A description of nozzles N7 to N20 is omitted. As described above, the HMP 20 recognizes onto which of the pixels each of the nozzles 61 has discharged ink. The position calculating circuit 34 calculates the position of each of the nozzles 61. Accordingly, the DMAC 38 outputs, for each of the nozzles 61, data of a pixel at the calculated position of the nozzle 61 and the discharging finish table 73 to the IJ recording head controller 44. The pixel recorder 71 obtains identification information for identifying the nozzle 61 and information about the pixel (e.g., the coordinates and the position) from the IJ recording head controller 44. The pixel recorder 71 outputs the identification information for identifying the nozzle 61 to the frequency recorder 72. Using the identification information, the frequency recorder 72 relates the identification information to the nozzles N1 to N20 and measures or counts the number of times when each of the nozzles 61 has discharged ink.

As the frequency recorder 72 records, for each of the nozzles N1 to N20, that the nozzle 61 has discharged ink for the number of times N (e.g., N pieces of ink droplets) after printing starts, the frequency recorder 72 determines that the nozzle 61 has discharged ink. According to this embodiment, N is three. Alternatively, N may be one, two, four, or more. If ink on the nozzle 61 is dry, the nozzle 61 may not discharge ink onto initial three pixels. To address this circumstance, the DMAC 38 causes the nozzle 61 to discharge ink onto the three pixels again.

As described above, the pixel recorder 71 records the pixels onto which the nozzle 61 discharges ink in the second method. The IJ recording head controller 44 does not discharge ink onto identical pixels. However, regarding the nozzle 61 that is related to a controlled number of times smaller than the number of times N by the nozzle rotation frequency table 74, even if the nozzle 61 has discharged ink, the IJ recording head controller 44 determines to cause the nozzle 61 to discharge ink. Accordingly, the HMP 20 suppresses degradation of image quality due to drying of ink on the nozzle 61.

A description is provided of processes performed by the HMP 20.

Figure 14:
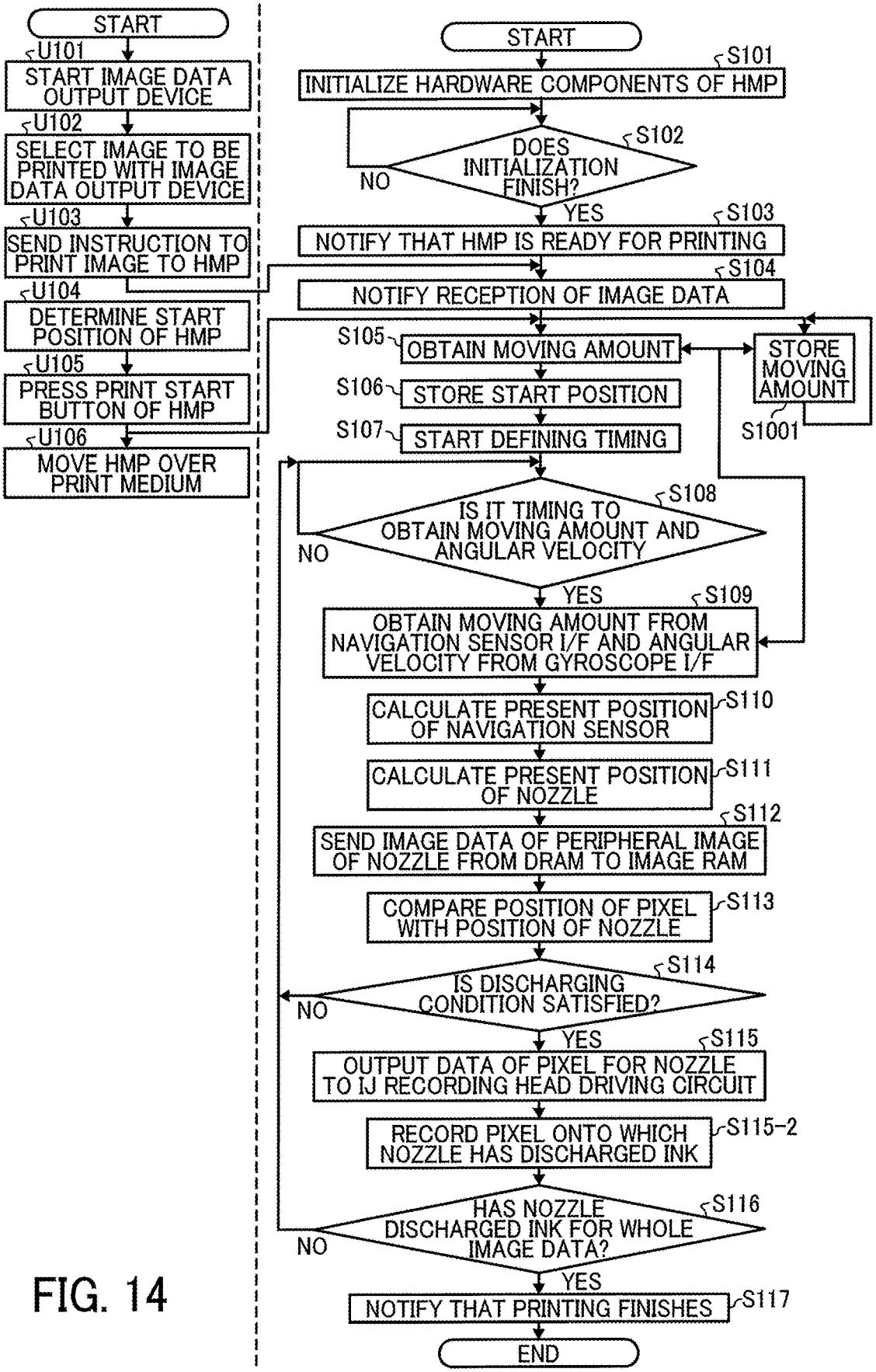
FIG. 14 is a flowchart of processes performed by the image data output device and the HMP depicted in FIGS. 2A and 2B.

FIG. 14 is a flowchart of processes performed by the image data output device 11 and the HMP 20 as one example. In FIG. 14, a left column illustrates the processes performed by the user with the image data output device 11 or the HMP 20. A right column illustrates the processes performed by the HMP 20. In step IJ 101, the user presses a power button of the image data output device 11. Accordingly, the image data output device 11 acknowledges pressing of the power button and starts as power is supplied from a battery or the like.

In step U102, the user selects an image to be printed by using the image data output device 11. Accordingly, the image data output device 11 acknowledges selection of the image. The user selects document data created by software such as a word processing application as the image. Alternatively, the user may select image data in joint photographic experts group (JPEG) or the like as the image. A printer driver may change data other than image data into the image, if necessary.

In step U103, the user sends an instruction to perform a print job to print the image to the HMP 20. The HMP 20 receives the instruction to perform the print job. Accordingly, the image data output device 11 sends image data for the print job to the HMP 20.

In step U104, the user holds the HMP 20 and places the HMP 20 at a start position on a print medium 12 (e.g., a page in a notebook).

In step U105, the user presses a print start button on the HMP 20. Accordingly, the HMP 20 acknowledges pressing of the print start button.

In step U106, the user moves the HMP 20 freely to scan the print medium 12 such that the HMP 20 slides over the print medium 12.

A description is provided of the processes performed by the HMP 20.

The CPU 33 executes the firmware to perform the processes described below.

The user powers on the HMP 20 to start the HMP 20. In step S101, the CPU 33 of the HMP 20 initializes the hardware components depicted in FIGS. 3 and 4 installed in the HMP 20. For example, the CPU 33 initializes a register of the navigation sensor I/F 42 and the gyroscope I/F 45 and sets a timing value to the print/sensor timing generator 43. The CPU 33 establishes communication between the HMP 20 and the image data output device 11.

In step S102, the CPU 33 determines whether initialization finishes. If initialization does not finish, the CPU 33 repeats determination.

If initialization finishes (YES in step S102), the CPU 33 notifies the user that the HMP 20 is ready for printing by lighting a light emitting diode (LED) of the OPU 26, for example, in step S103. Accordingly, the user recognizes that the HMP 20 is ready for printing and requests the HMP 20 to perform the print job as described above in step U103.

When the HMP 20 receives the print job, the communication I/F 27 of the HMP 20 receives the image data from the image data output device 11. The communication I/F 27 notifies the user of reception of the image data by blinking the LED of the OPU 26 or the like in step S104.

When the user places the HMP 20 at the start position on the print medium 12 and presses the print start button, the OPU 26 of the HMP 20 acknowledges placement of the HMP 20. The CPU 33 causes the navigation sensor I/F 42 to read the start position in step S105.

Accordingly, the navigation sensor I/F 42 communicates with the navigation sensor S0, receives a moving amount of the HMP 20 (e.g., the moving amount ($\Delta X'$, $\Delta Y'$)) detected by the navigation sensor S0, and stores the moving amount in a memory such as a register in step S1001. The CPU 33 retrieves the moving amount from the navigation sensor I/F 42.

Immediately after the user presses the print start button, the CPU 33 obtains the moving amount that is zero. However, even if the moving amount is not zero, the CPU 33 stores the moving amount in the DRAM 29 or a register or the like of the CPU 33 as the start position of the coordinates (0, 0), for example, in step S106.

When the CPU 33 obtains the start position, the print/sensor timing generator 43 starts defining a timing in step S107. At a timing to obtain the moving amount of the navigation sensor S0, which is set by initialization, the print/sensor timing generator 43 notifies the navigation sensor I/F 42 and the gyroscope I/F 45 of the defined timing as a reading timing. This process is performed cyclically to define the sampling cycle described above.

In step S108, the CPU 33 determines whether it is a timing to obtain the moving amount and the angular velocity. The CPU 33 performs determination in step S108 when the CPU 33 receives a notification from the interrupt controller 41. Alternatively, the CPU 33 may perform determination in step S108 by counting the timing also counted by the print/sensor timing generator 43.

At the timing to obtain the moving amount and the angular velocity, the CPU 33 obtains the moving amount from the navigation sensor I/F 42 and the angular velocity from the gyroscope I/F 45 in step S109. As described above, at the reading time defined by the print/sensor timing generator 43, the gyroscope I/F 45 obtains the angular velocity from the gyroscope 31. At the reading time defined by the print/sensor timing generator 43, the navigation sensor I/F 42 obtains the moving amount from the navigation sensor S0.

In step S110, the position calculating circuit 34 calculates the present position of the navigation sensor S0 based on the angular velocity and the moving amount. For example, the position calculating circuit 34 calculates the present position of the navigation sensor S0 based on the position (X, Y) calculated in a previous cycle and a moving distance that is calculated based on the moving amount ($\Delta X'$, $\Delta Y'$) and the angular velocity and is added to the present position. If the start position is available but the previously calculated position is not available, the position calculating circuit 34 calculates the present position of the navigation sensor S0 by adding the moving distance calculated based on the moving amount ($\Delta X'$, $\Delta Y'$) and the angular velocity that are obtained in the present cycle to the start position.

In step S111, the position calculating circuit 34 calculates the present position of each of the nozzles 61 based on the present position of the navigation sensor S0.

As described above, the print/sensor timing generator 43 obtains the angular velocity and the moving amount simultaneously or substantially simultaneously, thus calculating the position of the nozzle 61 based on the rotation angle of the HMP 20 and the moving amount obtained when the rotation angle is detected. Accordingly, even if the position of the nozzle 61 is calculated based on information from sensors of different types, accuracy in detecting the position of the nozzle 61 does not degrade easily.

In step S112, the CPU 33 controls the DMAC 38 and sends image data of a peripheral image of each of the nozzles 61 from the DRAM 29 to the image RAM 37 based on the calculated position of each of the nozzles 61. The rotator 39 rotates the image according to the position of the IJ recording head 24 specified by the user (e.g., a manner in which the user holds the HMP 20) and tilting of the IJ recording head 24.

In step S113, the IJ recording head controller 44 compares coordinates of the position of each of pixels that construct the peripheral image with coordinates of the position of each of the nozzles 61. The position calculating circuit 34 calculates acceleration of the nozzle 61 based on the previous position and the present position of the nozzle 61. Accordingly, the position calculating circuit 34 calculates the position of the nozzle 61 per ink discharging cycle of the IJ recording head 24 shorter than an obtaining cycle in which the navigation sensor IF 42 obtains the moving amount and the gyroscope IF 45 obtains the angular velocity.

In step S114, the IJ recording head controller 44 determines whether a discharging condition is satisfied. For example, the IJ recording head controller 44 determines whether the coordinates of the position of each of the pixels is within a predetermined range from the position of each of the nozzles 61 calculated by the position calculating circuit 34.

If the discharging condition is not satisfied (NO in step S114), step S108 is repeated. Conversely, if the discharging condition is satisfied (YES in step S114), the IJ recording head controller 44 outputs data of the pixel for each of the nozzles 61 to the IJ recording head driving circuit 23 in step S115. Thus, the IJ recording head 24 discharges ink onto the print medium 12.

Figure 15:
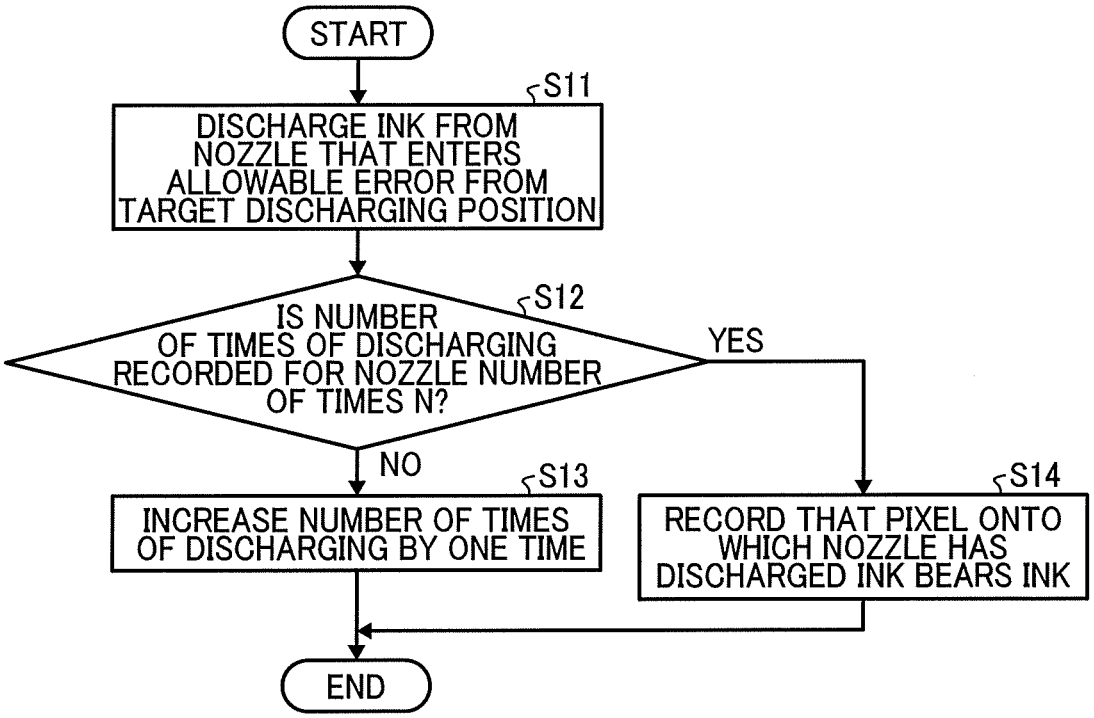
FIG. 15 is a flowchart of processes in which the HMP depicted in FIG. 2B updates finishing of discharging.

Subsequently to step S115, the pixel recorder 71 records the pixel onto which the nozzle 61 has discharged ink in step S115-2. However, the pixel recorder 71 does not record that ink has been discharged onto the pixel until each of the nozzles 61 attempts to discharge ink for the number of times N. FIG. 15 illustrates detailed processes performed by the pixel recorder 71.

In step S116, the CPU 33 determines whether the nozzle 61 has discharged ink for the whole image data. If the CPU 33 determines that the nozzle 61 has not discharged ink for the whole image data (NO in step S116), steps S108 to S115-2 are repeated.

If the CPU 33 determines that the nozzle 61 has discharged ink for the whole image data (YES in step S116), the CPU 33 lights the LED of the OPU 26, for example, to notify the user that printing finishes in step S117.

Alternatively, even if the nozzle 61 has not discharged ink for the whole image data, if the user is satisfied, the user may press a print finish button and the OPU 26 may acknowledge pressing of the print finish button and finish printing. After printing finishes, the user may power off the HMP 20. Alternatively, when printing finishes, the HMP 20 may be powered off automatically.

A description is provided of processes to update information that the nozzle 61 has discharged ink.

FIG. 15 is a flowchart of processes in which the HMP 20 updates finishing of discharging, that is, information that the nozzle 61 has discharged ink, as one example. The processes illustrated in FIG. 15 start when the nozzle 61 discharges ink.

In step S11, the IJ recording head controller 44 causes the nozzle 61 to discharge ink when the nozzle 61 enters the allowable error 62 from the target discharging position.

In step S12, the pixel recorder 71 refers to the nozzle rotation frequency table 74 to determine whether the number of times of discharging of ink that is recorded for the nozzle 61 that has discharged ink is the number of times N.

If the pixel recorder 71 determines that the number of times of discharging of ink is smaller than the number of times N (NO in step S12), the frequency recorder 72 increases the number of times of discharging of ink for the nozzle 61 that has discharged ink by one time in step S13.

Conversely, if the pixel recorder 71 determines that the number of times of discharging of ink is the number of times N (YES in step S12), the nozzle 61 discharges ink for the number of times N or more. Accordingly, in step S14, the pixel recorder 71 records finishing of discharging of ink to the discharging finish table 73. That is, the pixel recorder 71 records that the pixel, onto which the nozzle 61 has discharged ink, bears ink.

Under the processes described above, the pixel recorder 71 does not record finishing of discharging of ink for N pieces of pixels when printing starts. Accordingly, when the nozzle 61 returns to the identical pixels, the nozzle 61 discharges ink again, reducing dead pixels. Although it is not preferable for the nozzle 61 to discharge an ink droplet again onto the pixels that are not dead pixels, superimposing of ink droplets reduces degradation of image quality more effectively than dead pixels.

A description is provided of a second embodiment of the present disclosure.

The HMP 20 according to the first embodiment does not record finishing of discharging of ink to the pixel even if the nozzle 61 attempts to discharge ink up to the number of times N initially. The second embodiment describes a method for determining the number of times N. That is, the HMP 20 according to the second embodiment determines the number of times N properly.

A description is provided of drying of ink on the nozzle 61.

Figure 16:
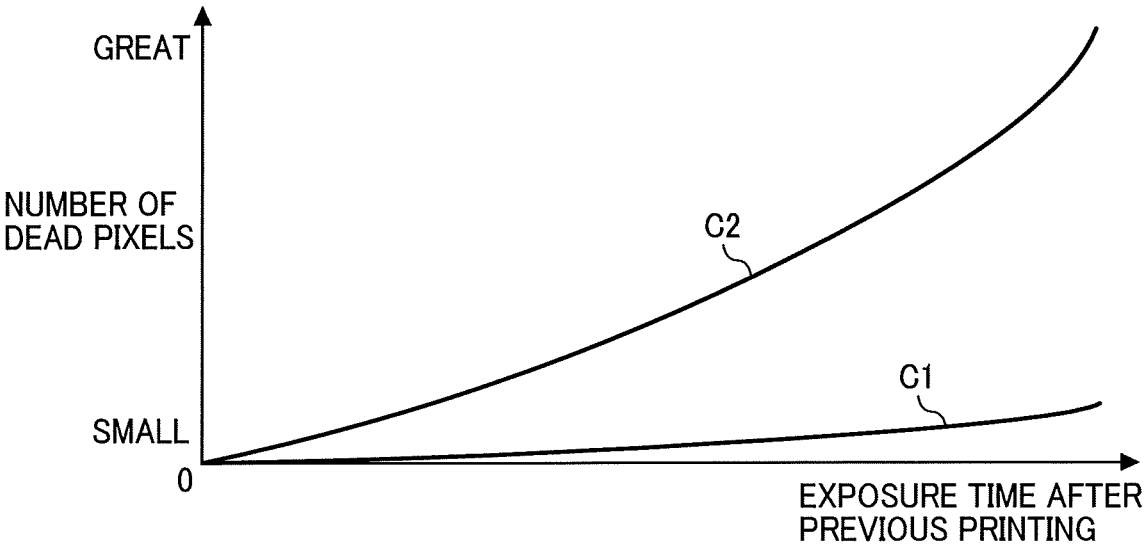
FIG. 16 is a graph schematically illustrating a relation between an exposure time after printing finishes and the number of dead dots generated by the HMP depicted in FIG. 2B.

FIG. 16 is a graph schematically illustrating a relation between an exposure time after printing finishes and the number of dead dots. FIG. 16 illustrates a curve C1 indicating the number of dead pixels (e.g., dots) when a cap covers the nozzle 61 and a curve C2 indicating the number of dead pixels when the cap does not cover the nozzle 61. The cap serves as a protector that shields the IJ recording head 24 from outside air and protects the nozzle 61 against drying. The curves C1 and C2 indicate that the number of dead pixels increases as the exposure time elapses. However, the number of dead pixels indicated by the curve C2 for the nozzle 61 without the cap is greater than the number of dead pixels indicated by the curve C1 for the nozzle 61 with the cap.

The nozzle 61 of the IJ recording head 24 is subject to ink clogging as the exposure time when the nozzle 61 is exposed to air increases. To address this circumstance, an inkjet printer having a sheet conveyer controls capping of a nozzle immediately after printing finishes. However, even if the nozzle is covered with a cap, it is difficult to retain a surface of the nozzle to be capable of discharging ink. To address this circumstance, the inkjet printer controls dummy discharge to remove ink from the nozzle before printing.

For example, a comparative HMP includes a mechanism that suppresses drying of ink adhered to a nozzle while the HMP is not used. The comparative HMP includes the nozzle, a moisturizing cap attached to the nozzle, and a wiping mechanism that removes ink from the nozzle.

However, even if the user attaches the moisturizing cap to the nozzle and removes the moisturizing cap from the nozzle when printing starts, it may be difficult to prevent drying of ink. To address this circumstance, the inkjet printer installed with the sheet conveyer performs dummy discharge before printing starts. For example, the nozzle discharges ink into a waste liquid tank to recover the nozzle and starts discharging ink for printing, thus preventing degradation of the image on the sheet caused by drying of ink.

However, if the comparative HMP performs dummy discharge, the nozzle discharges ink onto the sheet, forming an unnecessary image on the sheet. To address this circumstance, the user may move the comparative HMP over a waste sheet, for example, to cause the comparative HMP to perform dummy discharge onto the waste sheet. However, the user may prepare the waste sheet and move the comparative HMP more frequently, degrading usability for the user.

Since the HMP 20 is a printer moved by the user so that the HMP 20 scans the print medium 12, the HMP 20 is not installed with a motor that controls capping of the nozzle 61. Hence, the user performs capping of the nozzle 61. Since the OPU 26 merely urges the user to cover the nozzle 61 with the cap, the user is requested to cover the nozzle 61 with the cap finally. Accordingly, to address a case in which the user does not cover the nozzle 61 with the cap, the HMP 20 preferably detects a level of drying of ink held by the nozzle 61.

For example, in the thermal inkjet method, although the number of dead pixels varies depending on the diameter of the nozzle 61 and the prescription of ink, even after the nozzle 61 with the cap is exposed for one day, the number of dead pixels is in a range of from about 0 dot to about 6 dots for each of the nozzles 61. In this case, the number of discharging of ink, at which finishing of discharging of ink is not updated, is four or more due to a reason below. One dot of ink in the thermal inkjet method barely draws a line. A thin line is drawn with about three dots. Accordingly, in view of readability of letters and prevention of a broken line, a line is drawn with four counts because six continuous nozzles 61 barely suffer from dead pixels.

Conversely, there is data indicating that the nozzle 61 without the cap suffers from dead pixels in about one minute in an amount equivalent to an amount of dead pixels that appear in one day with the nozzle 61 with the cap.

To address this circumstance, according to this embodiment, under a control method in which finishing of discharging of ink is not recorded when printing starts, as the exposure time increases, the number of times N increases. Accordingly, even if the exposure time increases, the number of times N increases as the exposure time increases. That is, the HMP 20 increases the number of times for discharging ink until finishing of discharging of ink is recorded. Accordingly, the HMP 20 causes the nozzle 61 to discharge ink onto the target discharging position where a dead pixel appears, allowing the user to achieve a desired image.

A description is provided of a configuration of a controller 25S of an HMP 20S according to the second embodiment.

Figure 17:
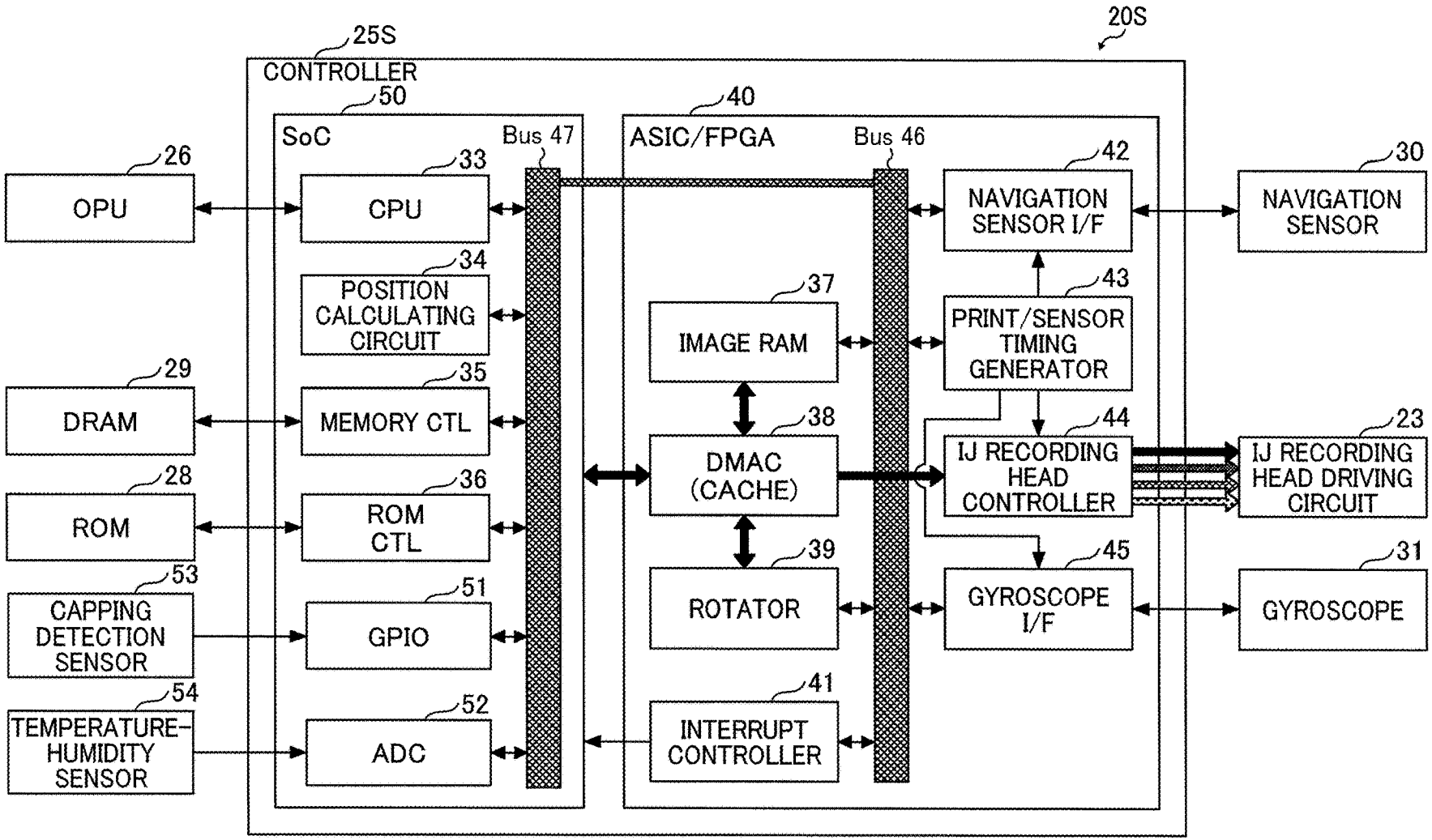
FIG. 17 is a block diagram of an HMP according to a second embodiment of the present disclosure.

FIG. 17 is a block diagram of the HMP 20S, illustrating the configuration of the controller 25S as one example. Referring to FIG. 17, the configuration of the controller 25S, which is different from the configuration of the controller 25 depicted in FIG. 4, is mainly described below. As illustrated in FIG. 17, the controller 25S includes a general-purpose input/output (GPIO) 51 and an analog-to-digital converter (ADC) 52. The GPIO 51 is a generic input/output interface. The ADC 52 is a converter that converts an analog signal into a digital signal. A capping detection sensor 53 is connected to the GPIO 51. A temperature-humidity sensor 54 is connected to the ADC 52. The ADC 52 is used if the temperature-humidity sensor 54 is an analog output device. If the temperature-humidity sensor 54 is a digital output device, the controller 25S may incorporate a generic interface (I/F) such as a serial peripheral interface (SPI) and an inter-integrated circuit (I2C).

The capping detection sensor 53 detects whether the nozzle 61 is capped, that is, covered with a cap. For example, the capping detection sensor 53 is an optical sensor that is transmission type or reflection type, a magnetic sensor that detects magnetism generated by a magnet or the like mounted on the cap, or a sensor incorporating a mechanical switch that is turned on and off physically.

According to this embodiment, the controller 25S determines the number of times N for which the nozzle 61 discharges ink until the pixel recorder 71 records finishing of discharging of ink according to the temperature and the humidity. Hence, the ROM CTL 36 stores a frequency determination table as table 1 below.

TABLE 1

| | | Humidity | | |
|---|---|---|---|---|
| | | L | M | H |
| Temperature | H | 1 | 2 | 3 |
| | M | 2 | 3 | 4 |
| | L | 3 | 4 | 5 |

Table 1 is one example of the frequency determination table describing the number of times for which the nozzle 61 discharges ink. The frequency determination table defines the number of times N for which the nozzle 61 discharges ink until the pixel recorder 71 records finishing of discharging of ink per combination of the temperature and the humidity. L, M, and H in temperature represent low temperature, medium temperature, and high temperature, which have certain ranges, respectively. Similarly, L, M, and H in humidity represent low humidity, medium humidity, and high humidity, which have certain ranges, respectively. As the humidity increases, ink borne by the nozzle 61 is not subject to drying. Hence, the frequency of discharging of ink decreases. Conversely, as the temperature increases, ink borne by the nozzle 61 is subject to drying. Hence, the frequency of discharging of ink increases.

A description is provided of processes performed by the HMP 20S.

Figure 18:
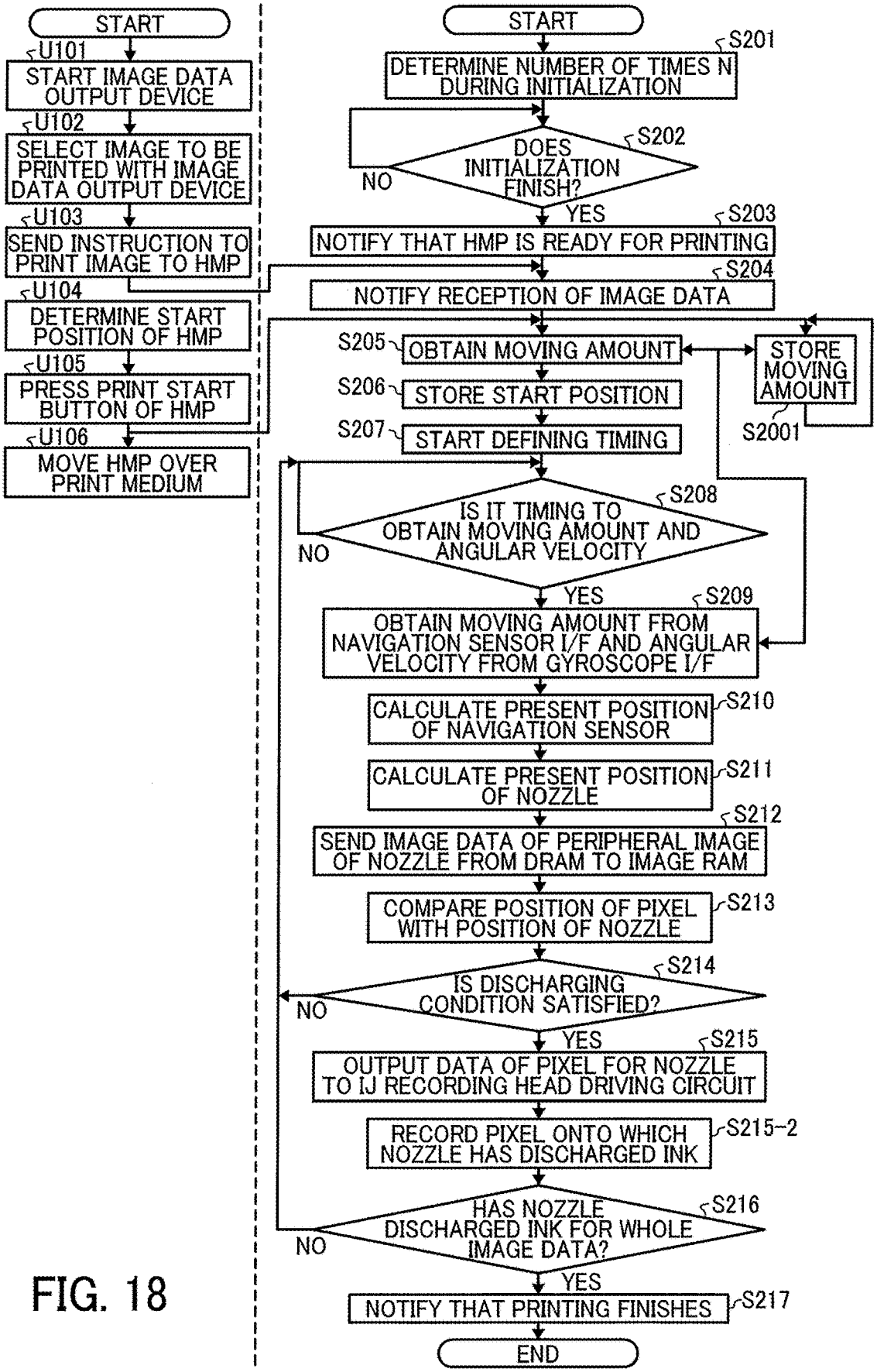
FIG. 18 is a flowchart of processes performed by the image data output device depicted in FIG. 2A and the HMP depicted in FIG. 17.

FIG. 18 is a flowchart of processes performed by the image data output device 11 and the HMP 20S as one example. In FIG. 18, a left column illustrates the processes performed by the user with the image data output device 11 or the HMP 20S. A right column illustrates the processes performed by the HMP 20S. Referring to FIG. 18, the processes performed by the HMP 20S, which are different from the processes performed by the HMP 20 depicted in FIG. 14, are mainly described below. The processes depicted in FIG. 18 are substantially equivalent to the processes depicted in FIG. 14. For example, steps S202 to S217 and step S2001 depicted in FIG. 18 are equivalent to steps S102 to S117 and step S1001 depicted in FIG. 14. However, step S201 in FIG. 18 is different from step S101 in FIG. 14. In step S201, during initialization, the pixel recorder 71 refers to the frequency determination table and determines the number of times N for which the nozzle 61 discharges ink until the pixel recorder 71 records finishing of discharging of ink. For example, the pixel recorder 71 obtains the temperature and the humidity from the temperature-humidity sensor 54 and detects the number of times N that corresponds to the temperature and the humidity that are obtained. Further, the pixel recorder 71 obtains information about whether the nozzle 61 is capped from the capping detection sensor 53. The pixel recorder 71 determines the number of times N based on the temperature and the humidity or a capping time when the nozzle 61 is capped as described below.

A description is provided of a method for determining the number of times N based on the capping time.

While the HMP 20 is powered on, since the capping detection sensor 53 detects capping in real time, the pixel recorder 71 measures the capping time of each of the nozzles 61. Immediately after the HMP 20 is powered on, the pixel recorder 71 measures an elapsed time from a power off time when the HMP 20 is powered off to a power on time when the HMP 20 is powered on. Hence, the CPU 33 records the power off time to the ROM CTL 36. Immediately after the HMP 20S is powered on, the pixel recorder 71 retrieves the power off time from the ROM CTL 36 and measures a capping time based on a difference from a present time. If the HMP 20S had been powered off, the pixel recorder 71 determines that the nozzle 61 was capped while the HMP 20S had been powered off. It is because the nozzle 61 is preferably covered by the cap while the HMP 20S is powered off. The pixel recorder 71 determines the number of times N based on data depicted in FIG. 16 for the capping time when the nozzle 61 is capped or a non-capping time when the nozzle 61 is not capped.

A description is provided of a method for determining the number of times N based on the temperature and the humidity.

The pixel recorder 71 obtains the temperature and the humidity and determines the number of times N based on the temperature and the humidity by referring to table 1. When the temperature-humidity sensor 54 detects the temperature and the humidity, the HMP 20S is powered on. Hence, the pixel recorder 71 obtains information about whether the nozzle 61 is capped and the capping time or the non-capping time. In this case, the pixel recorder 71 compares the number of times N determined based on the capping time or the non-capping time with the number of times N determined based on the temperature and the humidity and selects one of those numbers of times N which is greater than another as the number of times N used for control.

Thus, the HMP 20S according to this embodiment properly determines the number of times N for which the nozzle 61 discharges ink until the pixel recorder 71 records finishing of discharging of ink.

A description is provided of a third embodiment of the present disclosure.

The HMP 20 according to the third embodiment discharges ink for a plurality of times continuously onto an identical target discharging position until the number of times for which each of the nozzles 61 discharges ink exceeds a threshold after printing starts.

Figure 19B:
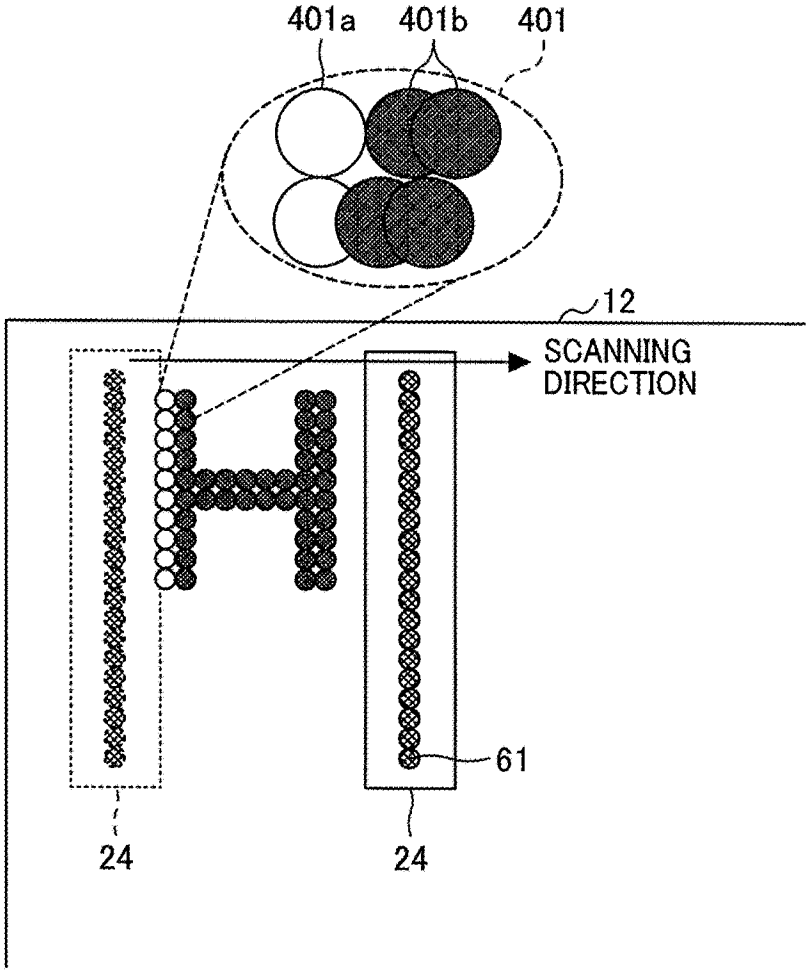
FIG. 19B is a schematic diagram of the HMP depicted in FIG. 19A, illustrating image formation.
Figure 19A:
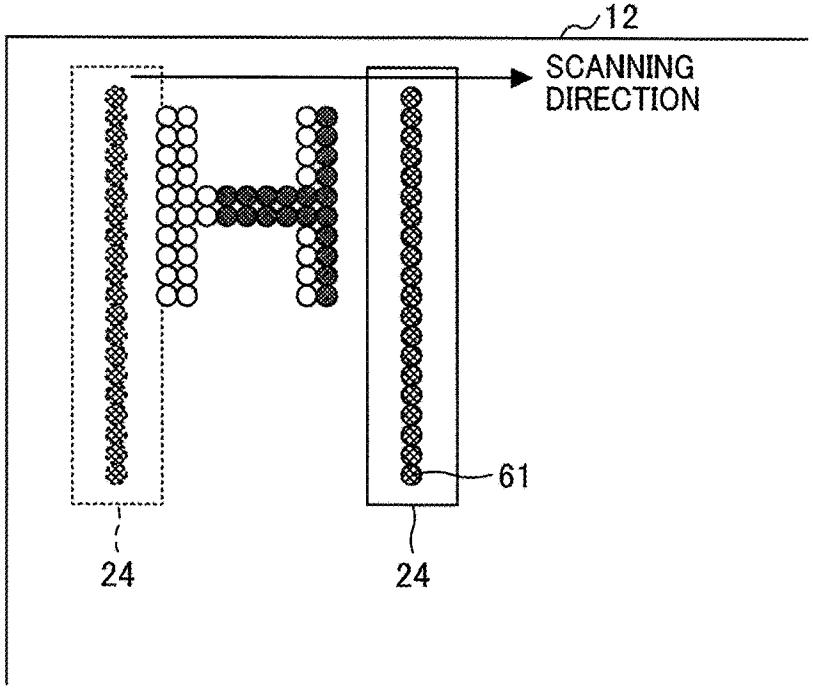
FIG. 19A is a schematic diagram of an HMP according to a third embodiment of the present disclosure.

FIGS. 19A and 19B illustrate the IJ recording head 24 and the print medium 12 for summarizing a control method performed by the HMP 20 according to the third embodiment as one example. FIG. 19A schematically illustrates dead pixels. As illustrated in FIG. 19A, each of the nozzles 61 generates three dead pixels. As illustrated in FIG. 19B, each of the nozzles 61 discharges ink onto pixel positions that form a leftmost vertical line of a letter H. Each of the nozzles 61 discharges ink continuously for the plurality of times onto an identical pixel position while each of the nozzles 61 moves from the pixel position on the leftmost vertical line of the letter H to pixel positions where the number of times for which each of the nozzles 61 discharges ink exceeds the threshold.

FIG. 19B illustrates an enlarged view 401 of dots in an upper left part of the letter H. The enlarged view 401 illustrates one white dot 401*a* and two black dots 401*b* aligned horizontally. After the nozzle 61 discharges ink onto the identical target discharging position for the plurality of times continuously, the nozzle 61 produces the white dot 401*a* as a dead pixel and the two black dots 401*b* that bear ink. As a result, the letter H is printed on the print medium 12 without a defective pixel. Since the number of dots that suffer from dead pixels varies depending on the nozzles 61, initial dots that bear ink may not be aligned precisely. However, the letter H is readable.

The plurality of times for which the nozzle 61 discharges ink is equal to or equivalent to the number of times N according to the first embodiment and the second embodiment. After the nozzle 61 discharges ink for the number of times N, the dead pixel is eliminated. The nozzle 61 discharges ink continuously to cause a plurality of ink droplets to hit an identical pixel position, not causing the plurality of ink droplets to hit different pixel positions, respectively. The nozzle 61 continuously discharges the plurality of ink droplets that are similar droplets created based on the image data, respectively. Alternatively, since the plurality of ink droplets eliminates dead pixels, the plurality of ink droplets may not be created based on the image data or may not be similar, respectively.

A description is provided of processes performed by the HMP 20 according to the third embodiment.

Figure 20:
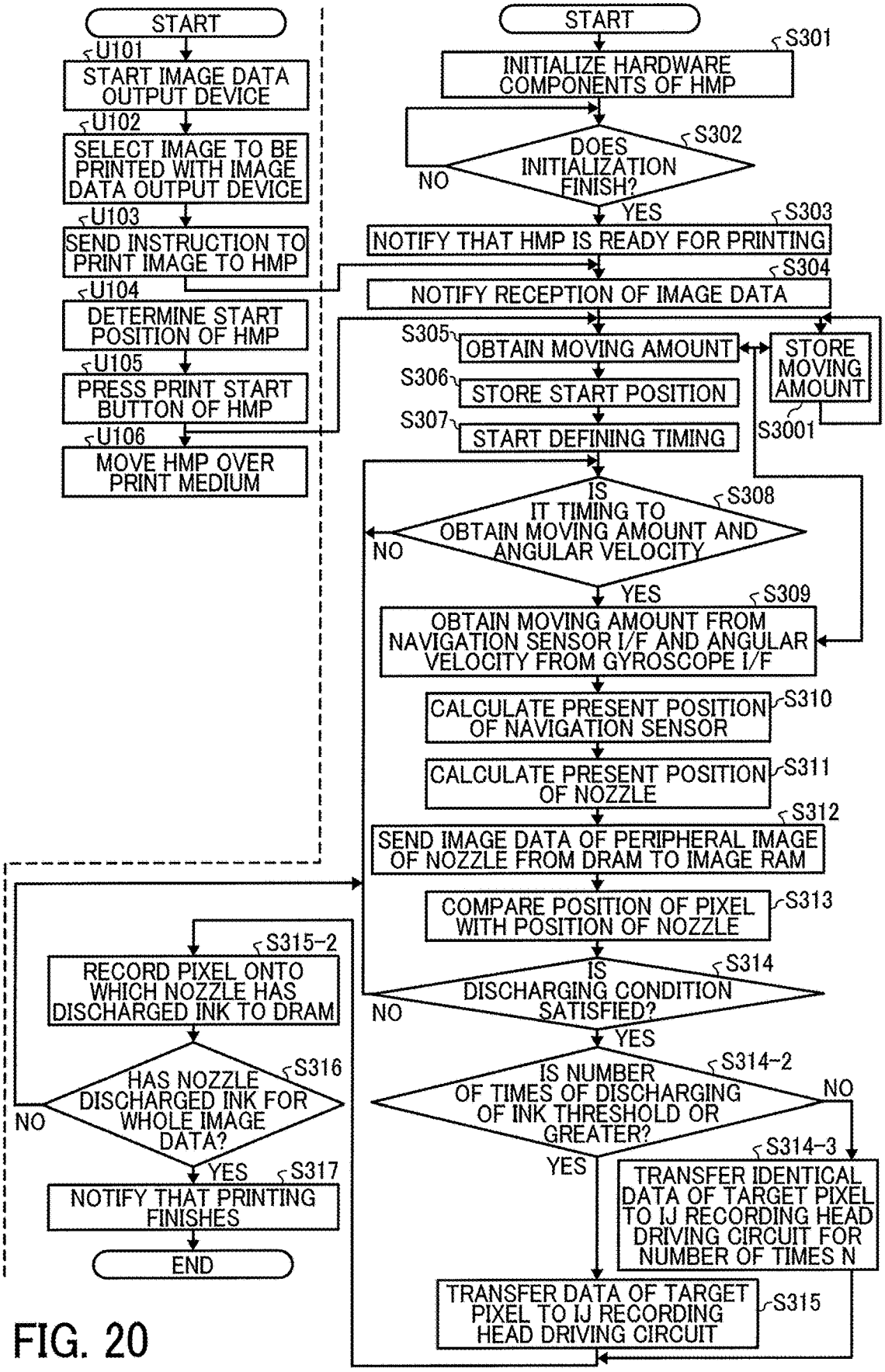
FIG. 20 is a flowchart of processes performed by the image data output device depicted in FIG. 2A and the HMP depicted in FIG. 19A.

FIG. 20 is a flowchart of processes performed by the image data output device 11 and the HMP 20 according to the third embodiment as one example. In FIG. 20, a left column illustrates the processes performed by the user with the image data output device 11 or the HMP 20. A right column illustrates the processes performed by the HMP 20. Referring to FIG. 20, the processes performed by the HMP 20, which are different from the processes performed by the HMP 20 depicted in FIG. 14, are mainly described below. Steps S301 to S314 and step S3001 depicted in FIG. 20 are equivalent to steps S101 to S114 and step S1001 depicted in FIG. 14.

If the IJ recording head controller 44 determines that the discharging condition is satisfied (YES in step S314), the IJ recording head controller 44 refers to the nozzle rotation frequency table 74 to determine whether the number of times of discharging of ink from the nozzle 61 after printing starts is a threshold or greater in step S314-2. The threshold is smaller than the number of times N. If the number of times N is 3, the threshold is 1 or 2.

If the IJ recording head controller 44 determines that the number of times of discharging of ink from the nozzle 61 after printing starts is the threshold or greater (YES in step S314-2), the IJ recording head controller 44 transfers data of a target pixel onto which the nozzle 61 discharges ink to the IJ recording head driving circuit 23 in step S315.

If the IJ recording head controller 44 determines that the number of times of discharging of ink from the nozzle 61 is not the threshold or greater (NO in step S314-2), the IJ recording head controller 44 transfers the identical data of the target pixel onto which the nozzle 61 discharges ink to the IJ recording head driving circuit 23 for the number of times N in step S314-3.

Thereafter, step S315-2 follows. In step S315-2, the pixel recorder 71 records the pixel onto which the nozzle 61 has discharged ink to the DRAM 29. Accordingly, the pixel at the target discharging position onto which the nozzle 61 has attempted to discharge ink at least once is masked, preventing repeated discharging. However, the pixel recorder 71 increases the number of times for which the nozzle 61 discharges ink by one time or the number of times N. Steps S316 and S317 depicted in FIG. 20 are equivalent to steps S116 and S117 depicted in FIG. 14.

According to the third embodiment, the nozzle 61 discharges ink for the number of times N continuously. Accordingly, even if the user does not move the HMP 20 to scan the identical target discharging position on the print medium 12 again, the HMP 20 forms an image with reduced dead pixels.

According to the third embodiment also, the number of times N may be determined based on the capping time, the non-capping time, and the temperature and the humidity.

A description is provided of a fourth embodiment of the present disclosure.

The HMP 20 according to the third embodiment discharges ink for the number of times N continuously. Conversely, the HMP 20 according to the fourth embodiment increases the size of a liquid droplet (e.g., an ink droplet).

Figure 21B:
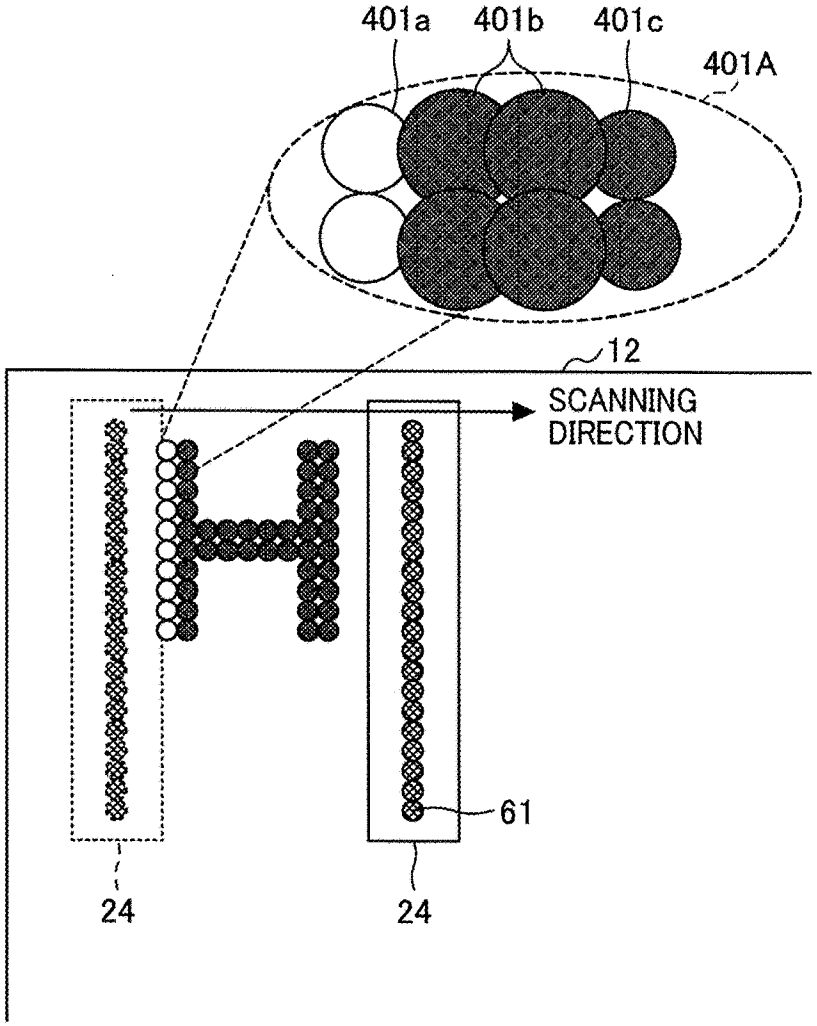
FIG. 21B is a schematic diagram of the HMP depicted in FIG. 21A, illustrating image formation.
Figure 21A:
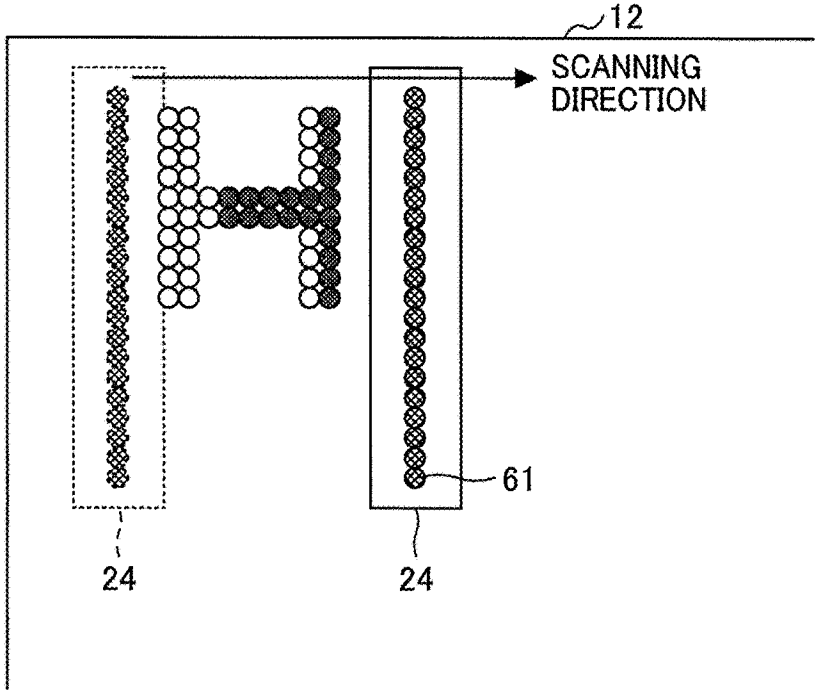
FIG. 21A is a schematic diagram of an HMP according to a fourth embodiment of the present disclosure.

FIGS. 21A and 21B illustrate the IJ recording head 24 and the print medium 12 for summarizing a control method performed by the HMP 20 according to the fourth embodiment as one example. FIG. 21A schematically illustrates dead pixels. As illustrated in FIG. 21A, each of the nozzles 61 generates three dead pixels. As illustrated in FIG. 21B, each of the nozzles 61 discharges ink onto pixel positions that form a leftmost vertical line of a letter H. When each of the nozzles 61 starts discharging ink, each of the nozzles 61 discharges an ink droplet having a size greater than a size of an ink droplet discharged regularly.

FIG. 21B illustrates an enlarged view 401A of dots in an upper left part of the letter H. The enlarged view 401A illustrates one white dot 401*a* and three black dots 401*b* and 401*c* aligned horizontally. The white dot 401*a* indicates a dead pixel created when the nozzle 61 attempts and fails to discharge a great size ink droplet. Each of the black dots 401*b* is a great size ink droplet discharged by the nozzle 61. The black dot 401*c* indicates a regular size ink droplet discharged by the nozzle 61. That is, the nozzle 61 fails to discharge ink at a first time and succeeds to discharge ink at a second time and thereafter.

When the nozzle 61 discharges the great size ink droplet, the great size ink droplet bears an amount of ink that is greater than an amount of ink borne by the regular size ink droplet, thus eliminating the dead pixel quickly. Accordingly, the HMP 20 eliminates the dead pixel earlier compared to a case in which the nozzle 61 merely discharges the regular size ink droplets for the number of times N. The great size ink droplet is greater than an ink droplet discharged according to image data. Alternatively, the great size ink droplet may be a maximum size ink droplet that the nozzle 61 is capable of discharging. If the ink droplet discharged according to the image data is the maximum size ink droplet that the nozzle 61 is capable of discharging, the maximum size ink droplet is defined as the great size ink droplet.

A description is provided of processes performed by the HMP 20 according to the fourth embodiment.

Figure 22:
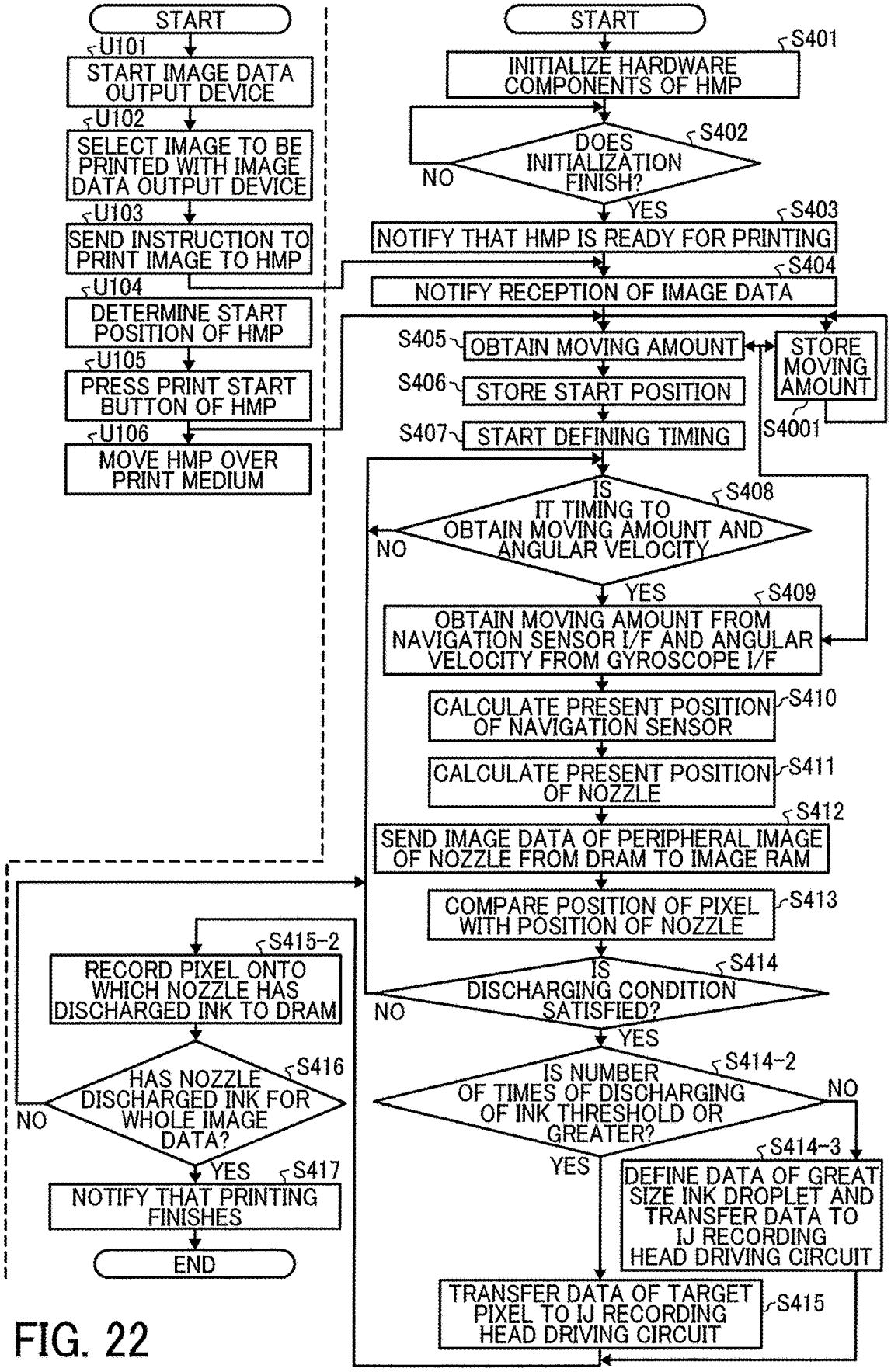
FIG. 22 is a flowchart of processes performed by the image data output device depicted in FIG. 2A and the HMP depicted in FIG. 21A.

FIG. 22 is a flowchart of processes performed by the image data output device 11 and the HMP 20 according to the fourth embodiment as one example. In FIG. 22, a left column illustrates the processes performed by the user with the image data output device 11 or the HMP 20. A right column illustrates the processes performed by the HMP 20. Referring to FIG. 22, the processes performed by the HMP 20, which are different from the processes performed by the HMP 20 depicted in FIG. 20, are mainly described below. Step S414-3 depicted in FIG. 22 replaces step S314-3 depicted in FIG. 20. Steps S401 to S414-2, steps S415 to S417, and step S4001 depicted in FIG. 22 are equivalent to steps S301 to S314-2, steps S315 to S317, and step S3001 depicted in FIG. 20.

In step S414-3, the IJ recording head controller 44 defines data that an ink droplet to be discharged is a great size ink droplet and transfers the data to the IJ recording head driving circuit 23.

In step S415-2, the pixel recorder 71 records a pixel onto which the nozzle 61 has discharged ink to the DRAM 29. However, the pixel recorder 71 increases the number of times for which the nozzle 61 discharges ink by one time.

As described above, the HMP 20 according to the fourth embodiment increases the size of the ink droplet discharged when printing starts, thus eliminating a dead pixel earlier. Alternatively, the threshold used in step S414-2 may be the number of times N. However, if the size of the ink droplet is great, the number of times N may be smaller than that according to the first embodiment and the second embodiment. The number of times N may be determined based on the capping time, the non-capping time, and the temperature and the humidity.

A description is provided of applications and variations of the HMP 20 and the HMP 20S.

The above-described embodiments are examples and are not limited to the above-described examples. The above-described embodiments are variously modified.

For example, each of the HMP 20 and the HMP 20S may be a handheld printer (HHP), a mobile printer, a handy printer, or the like.

The above-described embodiments use image data as text data. Alternatively, the image data may include an object such as a photograph, a figure, and a picture.

According to the above-described embodiments, the number of times N that is identical is applied to each of the nozzles 61. Alternatively, the number of times N may vary among the nozzles 61. For example, the user may specify the nozzle 61 that does not discharge ink readily through the OPU 26 or may divide the nozzles 61 into a plurality of groups that is applied with different numbers of times N, respectively.

The control methods according to the above-described embodiments may not be applied to all of the nozzles 61. For example, the control methods described above may be applied to at least one of the plurality of nozzles 61.

The components of each of the SoC 50 and the ASIC/FPGA 40 may be incorporated in either the SoC 50 or the ASIC/FPGA 40 according to performance of the CPU 33, the size of the circuit of the ASIC/FPGA 40, and the like.

In the HMP 20 and the HMP 20S according to the above-described embodiments, the nozzles 61 discharge ink to form an image. Alternatively, the HMP 20 and the HMP 20S may form an image by irradiating the print medium 12 with visible light, ultraviolet rays, infrared rays, laser beams, and the like. In this case, the print medium 12 is sensitive to heat and light, for example.

Alternatively, the nozzle 61 may discharge transparent liquid. In this case, as light having a particular wavelength range irradiates the transparent liquid on the print medium 12, the user obtains visible information. Yet alternatively, the nozzle 61 may discharge metal paste, resin, or the like.

The number of the gyroscope 31 is not limited to one. Each of the HMP 20 and the HMP 20S may incorporate two or more gyroscopes 31.

The position calculating circuit 34 is one example of a position calculator. The IJ recording head controller 44 is one example of a liquid droplet discharger or a liquid droplet discharging controller. The frequency recorder 72 is one example of a discharging frequency recorder. The pixel recorder 71 is one example of a pixel recorder. The temperature-humidity sensor 54 is one example of a temperature-humidity detector. The capping detection sensor 53 is one example of an attachment detector or a capping detector. The navigation sensor 30 is one example of a first sensor. The gyroscope 31 is one example of a second sensor.

A description is provided of advantages of a liquid droplet discharging apparatus (e.g., the HMP 20 and the HMP 20S).

As illustrated in FIG. 2B, the liquid droplet discharging apparatus discharges a liquid droplet onto a medium (e.g., the print medium 12). As illustrated in FIGS. 1A, 4, and 12, the liquid droplet discharging apparatus includes a plurality of nozzles (e.g., the nozzles 61), a liquid droplet discharging controller (e.g., the IJ recording head controller 44), and a frequency recorder (e.g., the frequency recorder 72).

The liquid droplet discharging controller receives image data. The liquid droplet discharging controller controls each of the nozzles to discharge the liquid droplet in an amount defined by the image data onto a target discharging position on the medium, which corresponds to a pixel position defined by the image data. The liquid droplet discharging controller controls at least one of the nozzles to discharge the liquid droplet for a controlled number of times smaller than a number of times N. N represents an integer not smaller than 2. The frequency recorder records the controlled number of times of discharging for each of the at least one of the nozzles. The liquid droplet discharging controller controls the at least one of the nozzles to discharge the liquid droplet in an amount greater than the amount defined by the image data onto the target discharging position on the medium.

Accordingly, the liquid droplet discharging apparatus suppresses failure caused by drying of the nozzle.

The advantages achieved by the embodiments described above are examples and therefore are not limited to those described above.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A liquid droplet discharging apparatus being movable and comprising:

a plurality of nozzles to discharge a liquid droplet onto a medium; and circuitry configured to receive image data, control each of the nozzles to discharge the liquid droplet in an amount defined by the image data onto a target discharging position on the medium, which corresponds to a pixel position defined by the image data;

record a controlled number of times of discharging smaller than a number of times N, N representing an integer not smaller than 2, for each of the nozzles;

determine, from the recorded controlled number of times, whether at least one of the nozzles should be controlled to discharge the liquid droplet again onto the target discharging position on the medium; and in response to determination that said at least one of the nozzles should be controlled to discharge the liquid droplet again onto the target discharging position on the medium, control said at least one of the nozzles to discharge the liquid droplet again onto the target discharging position on the medium.

2. The liquid droplet discharging apparatus according to claim 1, further comprising a plurality of sensors to detect a moving amount of the liquid droplet discharging apparatus, wherein the circuitry is configured to control the each of the nozzles to discharge the liquid droplet in the amount defined by the image data onto the target discharging position on the medium based on the detected moving amount.

3. The liquid droplet discharging apparatus according to claim 1, further comprising:

a first sensor to detect a moving amount of the liquid droplet discharging apparatus; and a second sensor to detect an angular velocity of the liquid droplet discharging apparatus, wherein the circuitry is configured to control the each of the nozzles to discharge the liquid droplet in the amount defined by the image data onto the target discharging position on the medium based on the detected moving amount and the detected angular velocity.

4. The liquid droplet discharging apparatus according to claim 3, wherein the first sensor includes a navigation sensor and the second sensor includes a gyroscope.

5. The liquid droplet discharging apparatus according to claim 1, wherein the circuitry is configured to control the at least one of the nozzles to discharge the liquid droplet having a size greater than a size defined by the image data until the at least one of the nozzles discharges the liquid droplet for the number of times N or more.

6. The liquid droplet discharging apparatus according to claim 1, wherein the circuitry is further configured to record the pixel position defined by the image data, wherein the circuitry is configured not to record the pixel position for which the circuitry controls the at least one of the nozzles to discharge the liquid droplet for a controlled number of times smaller than the number of times N plus one, and wherein the circuitry is configured to control the each of the nozzles to discharge the liquid droplet based on the image data corresponding to the pixel position not recorded.

7. The liquid droplet discharging apparatus according to claim 6, further comprising a temperature-humidity detector to detect at least one of a temperature or a humidity, wherein the circuitry is configured to determine the number of times N according to the at least one of the temperature or the humidity detected by the temperature-humidity detector.

8. The liquid droplet discharging apparatus according to claim 6, further comprising a capping detector to detect capping of the plurality of nozzles, wherein the circuitry is configured to determine the number of times N based on one of a capping time and a non-capping time elapsed from finishing of a previous printing.

9. A liquid droplet discharging method comprising:

receiving image data;

controlling each of a plurality of nozzles to discharge a liquid droplet in an amount defined by the image data onto a target discharging position on a medium, which corresponds to a pixel position defined by the image data;

recording a controlled number of times of discharging smaller than a number of times N, N representing an integer not smaller than 2, for each of the nozzles;

determining, from the recorded controlled number of times, whether at least one of the nozzles should be controlled to discharge the liquid droplet again onto the target discharging position on the medium; and in response to determination that said at least one of the nozzles should be controlled to discharge the liquid droplet again onto the target discharging position on the medium, controlling said at least one of the nozzles to discharge the liquid droplet again onto the target discharging position on the medium.

10. A non-transitory computer readable medium storing a plurality of instructions, which when executed by one or more processors, causes the processors to perform a method, the method comprising:

receiving image data;

controlling each of a plurality of nozzles to discharge a liquid droplet in an amount defined by the image data onto a target discharging position on a medium, which corresponds to a pixel position defined by the image data;

recording a controlled number of times of discharging smaller than a number of times N, N representing an integer not smaller than 2, for each of the nozzles, determining, from the recorded controlled number of times, whether at least one of the nozzles should be controlled to discharge the liquid droplet again onto the target discharging position on the medium; and in response to determination that said at least one of the nozzles should be controlled to discharge the liquid droplet again onto the target discharging position on the medium, controlling said at least one of the nozzles to discharge the liquid droplet again onto the target discharging position on the medium.

* * * * *